US012392260B1

(12) United States Patent
Zhang et al.

(10) Patent No.: US 12,392,260 B1
(45) Date of Patent: Aug. 19, 2025

(54) STEAM POWER CYCLE THERMOELECTRIC DECOUPLING SYSTEM, AND CONTROL METHOD, DEVICE, MEDIUM, AND PRODUCT THEREOF

(71) Applicant: NORTH CHINA ELECTRIC POWER UNIVERSITY, Beijing (CN)

(72) Inventors: Hanfei Zhang, Beijing (CN); Yuanhui Wang, Beijing (CN); Liqiang Duan, Beijing (CN); Bohan Shang, Beijing (CN); Jiaping Guo, Beijing (CN); Shuaiyu Ji, Beijing (CN); Liping Pang, Beijing (CN); Yongping Yang, Beijing (CN)

(73) Assignee: NORTH CHINA ELECTRICAL POWER UNIVERSITY, Beijing (CN)

( * ) Notice: Subject to any disclaimer, the term of this patent is extended or adjusted under 35 U.S.C. 154(b) by 0 days.

(21) Appl. No.: 19/184,093

(22) Filed: Apr. 21, 2025

(30) Foreign Application Priority Data

May 24, 2024 (CN) ..... 202410658278.1

(51) Int. Cl.

| | |
|---|---|
| ***F01K 3/14*** | (2006.01) |
| ***F01K 1/02*** | (2006.01) |
| ***F01K 1/16*** | (2006.01) |
| ***F24D 11/00*** | (2022.01) |
| ***F24D 19/00*** | (2006.01) |
| ***F28D 20/00*** | (2006.01) |

(52) U.S. Cl.
CPC ..... *F01K 3/14* (2013.01); *F01K 1/02* (2013.01); *F01K 1/16* (2013.01); *F24D 11/00* (2013.01); *F24D 19/00* (2013.01); *F28D 2020/0047* (2013.01)

(58) Field of Classification Search
CPC ..... F01K 3/14; F01K 1/02; F01K 1/16; F24D 11/00; F24D 19/00; F28D 2020/0047
USPC ..... 60/659
See application file for complete search history.

(56) References Cited

U.S. PATENT DOCUMENTS 8,904,793 B2 * 12/2014 Hemrle ..... F28D 20/021 60/659
2012/0131915 A1 * 5/2012 Olavarria Rodriguez-Arango ..... F01K 3/008 60/659

FOREIGN PATENT DOCUMENTS

CN 111237732 A * 6/2020 ..... F22B 1/06
CN 215061976 U * 12/2021
CN 117029081 A 11/2023

* cited by examiner

*Primary Examiner* — Hoang M Nguyen
(74) *Attorney, Agent, or Firm* — Ming Jiang; OPENPTO US LLC

(57) ABSTRACT

A steam power cycle thermoelectric decoupling system includes a molten salt heat storage system, a steam accumulator heat storage system, and a preheating system. The steam accumulator heat storage system is taken as a main heat storage component, which solves low heat storage efficiency and high heat storage costs by simply using molten salt. Saturated steam released by the steam accumulator heat storage system is heated to a superheated state by heat stored in the molten salt heat storage system, achieving supplement of the saturated steam released by the steam accumulator heat storage system to the heat supply network, and the preheating system is utilized for solving the problem that the temperature of steam output from the steam accumulator heat storage system is lower than the solidifying point temperature of the molten salt, causing the solidification of molten salt.

19 Claims, 3 Drawing Sheets

STEAM POWER CYCLE THERMOELECTRIC DECOUPLING SYSTEM, AND CONTROL METHOD, DEVICE, MEDIUM, AND PRODUCT THEREOF

CROSS REFERENCE TO RELATED APPLICATION

This patent application claims the benefit and priority of Chinese Patent Application No. 202410658278.1, entitled "STEAM POWER CYCLE THERMOELECTRIC DECOUPLING SYSTEM, AND CONTROL METHOD, DEVICE, MEDIUM, AND PRODUCT THEREOF" filed on May 24, 2024, the disclosure of which is incorporated by reference herein in its entirety as part of the present application.

TECHNICAL FIELD

The present disclosure relates to the field of steam power cycle thermoelectric decoupling control, and in particular, to a steam power cycle thermoelectric decoupling system, and control method, device, medium, and product thereof.

BACKGROUND

With continuous and vigorous development of new energy, installed capacity of new energy equipment is increasing. However, disadvantages, such as randomness, intermittency, and fluctuation of new energy power generation output, will greatly affect power dispatching and coordinated operation of a power grid. To mitigate impact of fluctuating renewable power on a power system, construction of a new power system requires a conventional steam power cycle unit to have high load adaptability and operational flexibility to enhance a large-scale consumption capacity of new energy power.

The conventional steam power cycle unit may be classified into a pure condensate power generation unit and a combined heat and power (CHP) unit. The CHP unit is an effective means to improve heat efficiency and economy of a steam power cycle power plant and achieve energy conservation and emission reduction. The CHP unit usually has a problem that heat energy supply and demand cannot be matched with a power generation load. In a low grid load period, it is often impossible to further reduce the power load due to the demand for ensuring heat supply. In a high grid load period of, the CHP unit cannot operate at a full load due to the demand for heat supply.

For a key problem of thermoelectric mismatch of the CHP unit, a conventional method is to increase boiler capacity in a design stage to ensure that steam generated by the boiler can meet both the power generation load of the unit and a demand for heat supply steam during low or full load operation of the unit. However, this will increase boiler costs, and exacerbate a hydrodynamic safety risk during low load operation of the boiler. Moreover, this method is only applicable to new units, and cannot be used for flexibility retrofits of existing units.

In addition, some gas-steam combined cycle units of CHP units also are affected by fluctuations in heat and power loads on a demand side, so as to adopt a day-start and night-stop operation mode. At present, in order to meet a nighttime heat load demand, a gas-fired boiler in the power plant needs to operate for a long time, which causes low-quality utilization of high-quality energy, and a sharp increase in operation costs.

As a key technology for flexibility retrofits of the CHP unit, thermoelectric decoupling can effectively improve power generation load flexibility of a thermal plant, and solves a limitation of the heat supply demand on the power generation load of the unit. At present, a conventional thermoelectric decoupling technology usually uses a molten salt heat storage technology to achieve energy storage. A molten salt heating mode includes a mode for steam heating molten salt, in which the molten salt is usually heated by extracting high-quality steam, simultaneously achieving an objective of reducing work done by a steam turbine to reduce the power generation load of the unit. However, due to a relatively high crystallization temperature of the molten salt, the molten salt heat storage system has a limited heat storage capacity to steam with medium and low parameter. Meanwhile, the molten salt heat storage system can only store some high-grade sensible heat of the steam, but cannot store remaining medium and low-grade sensible heat and all latent heat, which results in significant limitations on heat storage capacity of the molten salt heat storage system. Therefore, the conventional mode for steam heating molten salt has the problems of low molten salt heat storage efficiency and high heat storage costs.

SUMMARY

An objective of the present disclosure is to provide a steam power cycle thermoelectric decoupling system, and control method, device, medium, and product thereof, so as to solve problems of low molten salt heat storage efficiency and high heat storage costs while achieving thermoelectric decoupling.

To achieve the objective, the present disclosure provides the following solution:

According to one aspect, the present disclosure provides a steam power cycle thermoelectric decoupling system. The system includes: a molten salt heat storage system, a steam accumulator heat storage system, and a preheating system.

One end of a steam side of a first steam-molten salt heat exchanger of the molten salt heat storage system is connected to a preset steam extraction position of a steam power cycle unit, and the other end of the steam side of the first steam-molten salt heat exchanger is connected to a steam inlet of the steam accumulator heat storage system. The first steam-molten salt heat exchanger is configured to heat molten salt in the molten salt heat storage system by using steam extracted from the steam power cycle unit. The steam accumulator heat storage system is at least configured to store steam output from the steam side of the first steam-molten salt heat exchanger.

A steam outlet of the steam accumulator heat storage system is connected to a steam inlet of the preheating system, a steam outlet of the preheating system is connected to one end of a steam side of a second steam-molten salt heat exchanger of the molten salt heat storage system, and the other end of the steam side of the second steam-molten salt heat exchanger is connected to a heat supply network. The preheating system is capable of preheating saturated steam output from the steam accumulator heat storage system to enable that a temperature of the preheated saturated steam is not lower than a solidifying point temperature of the molten salt in the molten salt heat storage system.

The saturated steam flowing through the second steam-molten salt heat exchanger is heated by the heated molten salt heated in the molten salt heat storage system to form superheated steam.

Optionally, the preheating system includes: a heater and a heat regenerator.

A steam inlet of the heater is connected to the steam outlet of the steam accumulator heat storage system, and a steam outlet of the heater is connected to the end of the steam side of the second steam-molten salt heat exchanger.

A primary side of the heat regenerator is connected to the heat supply network, a steam inlet of a secondary side of the heat regenerator is connected to the steam outlet of the steam accumulator heat storage system, and a steam outlet of the secondary side of the heat regenerator is connected to the end of the steam side of the second steam-molten salt heat exchanger.

The heater is capable of preheating the saturated steam output from the steam accumulator heat storage system.

The heat regenerator is capable of preheating the saturated steam output from the steam accumulator heat storage system through steam extracted from the heat supply network.

Optionally, the preheater is a steam heater.

A primary side of the steam heater is connected to the steam power cycle unit, a steam inlet of a secondary side of the steam heater is connected to the steam outlet of the steam accumulator heat storage system, and a steam outlet of the secondary side of the steam heater is connected to the end of the steam side of the second steam-molten salt heat exchanger.

The steam heater is capable of preheating the saturated steam output from the steam accumulator heat storage system through the steam extracted from the steam power cycle unit.

Optionally, the preheating system further includes: a bypass pipeline.

One end of the bypass pipeline is connected to the steam outlet of the steam accumulator heat storage system, and the other end of the bypass pipeline is connected to the end of the steam side of the second steam-molten salt heat exchanger.

Optionally, a first regulating valve is arranged between the steam inlet of the heater and the steam outlet of the steam accumulator heat storage system, and a second regulating valve is arranged between the steam inlet of the secondary side of the heat regenerator and the steam outlet of the steam accumulator heat storage system.

A fifth regulating valve is arranged between a steam inlet of the primary side of the heat regenerator and the heat supply network.

Optionally, a third regulating valve is arranged between the preset steam extraction position of the steam power cycle unit and the end of the steam side of the first steam-molten salt heat exchanger, and a fourth regulating valve is arranged between the other end of the steam side of the first steam-molten salt heat exchanger and the steam inlet of the steam accumulator heat storage system.

Optionally, a sixth regulating valve is arranged on the bypass pipeline.

A control method for the steam power cycle thermoelectric decoupling system includes the following steps:

calculating, according to a gap flow rate of heat supply steam and a gap duration of the heat supply steam, a flow rate of heat storage steam and a flow rate of heating molten salt in a heat storage stage, and calculating a flow rate of the heat supply steam and a flow rate of heat supply molten salt in a heat release stage;

in the heat storage stage:

controlling a real-time flow rate of extracted steam at the preset steam extraction position of the steam power cycle unit according to the flow rate of the heat storage steam, and controlling a real-time flow rate of molten salt that needs to be heated in the molten salt heat storage system according to the flow rate of the heating molten salt until a requirement on total mass of required heat storage steam is met, where the total mass of the required heat storage steam is determined by the gap flow rate of the heat supply steam and the gap duration of the heat supply steam;

in the heat release stage:

controlling, according to the flow rate of the heat supply steam, a real-time flow rate of saturated steam output from the steam accumulator heat storage system to the second steam-molten salt heat exchanger until the heat release stage ends, where when a starting condition is satisfied, the saturated steam output from the steam accumulator heat storage system is preheated by the preheating system to a temperature not lower than the solidifying point temperature of the molten salt and then is output to the second steam-molten salt heat exchanger; and controlling, according to the flow rate of the heat supply molten salt, a real-time flow rate of the molten salt for heating in the molten salt heat storage system until the heat release stage ends.

Optionally, when the steam accumulator heat storage system includes one steam accumulator, calculating, according to the gap flow rate of the heat supply steam and the gap duration of the heat supply steam, the flow rate of the heat storage steam and the flow rate of the heating molten salt in the heat storage stage specifically includes:

calculating a total mass of the heat supply steam according to the gap flow rate of the heat supply steam and the gap duration of the heat supply steam;

determining, according to the total mass of the heat supply steam, parameters of a full-charged final state of the single steam accumulator satisfying a heat supply condition, where the parameters of the full-charged final state include a pressure and a saturation temperature in the full-charged final state;

calculating, according to the parameters of the full-charged final state of the single steam accumulator satisfying the heat supply condition, a mass of heating steam that is capable of being stored in the single steam accumulator as a target mass;

calculating the flow rate of the heat storage steam and a duration of the heat storage stage according to the target mass; and calculating the flow rate of the heating molten salt by using a principle of energy conservation according to the flow rate of the heat storage steam.

Optionally, when the steam accumulator heat storage system includes a plurality of steam accumulators, calculating, according to the gap flow rate of the heat supply steam and the gap duration of the heat supply steam, the flow rate of the heat storage steam and the flow rate of the heating molten salt in the heat storage stage specifically includes:

calculating a total mass of the heat supply steam according to the gap flow rate of the heat supply steam and the gap duration of the heat supply steam;

calculating total energy of steam and water and a total mass of the steam and water in a single steam accumulator in a full-charged final state;

calculating, according to the total energy of the steam and water and the total mass of the steam and water in the single steam accumulator in the full-charged final state, a mass of heating steam that is capable of being stored in the single steam accumulator;

calculating, according to the total energy of the steam and water and the total mass of the steam and water in the single steam accumulator in the full-charged final state, a mass of the heat supply steam that is capable of being provided by the single steam accumulator;

calculating, according to the mass of the heat supply steam that is capable of being provided by the single steam accumulator and the total mass of the heat supply steam, a quantity of required steam accumulators as a target quantity;

calculating the flow rate of the heat storage steam and a duration of the heat storage stage according to a target mass, where the target mass is a total mass of the heating steam that is capable of being stored in the target quantity of the steam accumulators in the heat storage stage; and calculating the flow rate of the heating molten salt by using a principle of energy conservation according to the flow rate of the heat storage steam.

Optionally, the Heat Supply Condition is:

$$m_g \geq m_{heat1};$$

$$m_g = \frac{\left(m_a - \frac{m_a \times h_{g2} - H_a}{h_{g2} - h_{w2}}\right) \times v_{g2} - \left(V_3 - \frac{m_a \times h_{g2} - H_a}{h_{g2} - h_{w2}} \times v_{w2}\right)}{v_{g2}};$$

$$m_a = m_{w1} + m_{g1};$$

$$H_a = H_{w1} + H_{g1};$$

$$m_{w1} = \frac{V_{w1}}{v_{w1}};$$

$$m_{g1} = \frac{V_{g1}}{v_{g1}};$$

$$H_{w1} = \frac{m_{w1}}{h_{w1}};$$

$$H_{g1} = \frac{m_{g1}}{h_{g1}};$$

$$V_{w1} = \pi \times L^2 \times r_3 - \frac{\pi \times L^3}{3};$$

$$V_{g1} = V_3 - V_{w1};$$

where $m_g$ is the mass of the heat supply steam that is capable of being provided by the single steam accumulator, $m_{heat1}$ is the total mass of the heat supply steam, $m_a$ is the total mass of the steam and water in the single steam accumulator in the full-charged final state, $H_a$ is the total energy of the steam and water in the single steam accumulator in the full-charged final state, $h_{w2}$ and $h_{g2}$ are respectively a specific enthalpy value of saturated water and a specific enthalpy value of saturated steam in the steam accumulator in a final state after steam supply, and $v_{w2}$ and $v_{g2}$ are respectively a specific volume of the saturated water and a specific volume of the saturated steam in the single steam accumulator in the final state after steam supply;

$m_{w1}$ and $m_{g1}$ are respectively a mass of the water and a mass of the steam in the single steam accumulator in the full-charged final state, and $H_{w1}$ and $H_{g1}$ are respectively energy of the water and energy of the steam in the single steam accumulator in the full-charged final state;

$V_{w1}$ and $V_{g1}$ are respectively a volume of the water and a volume of the steam in the single steam accumulator in the full-charged final state, and $v_{w1}$ and $v_{g1}$ are respectively a specific volume of the saturated water and a specific volume of the saturated steam in the single steam accumulator in the full-charged final state;

$h_{w1}$ and $h_{g1}$ are respectively a specific enthalpy value of the saturated water and a specific enthalpy value of the saturated steam in the single steam accumulator in the full-charged final state; and $h_{w1}$, $h_{g1}$, $v_{w1}$, and $v_{g1}$ are respectively obtained in a mode of searching a steam enthalpy-entropy table according to the parameters of the full-charged final state; and L is a liquid level height in the single steam accumulator in the full-charged final state, $r_3$ is a radius of the single steam accumulator, and $V_3$ is a volume of the single steam accumulator.

Optionally, a pressure of the single steam accumulator in the full-charged final state is a rated pressure, and a saturation temperature of the single steam accumulator in the full-charged final state is the saturation temperature corresponding to the rated pressure;

calculating the total energy of the steam and water and the total mass of the steam and water in the single steam accumulator in the full-charged final state specifically includes:

determining, according to the rated pressure and the saturation temperature corresponding to the rated pressure, the specific enthalpy value of the saturated water, the specific enthalpy value of the saturated steam, the specific volume of the saturated water, and the specific volume of the saturated steam in the single steam accumulator in the full-charged final state in a mode of searching the steam enthalpy-entropy table; and calculating the total energy of the steam and water and the total mass of the steam and water in the single steam accumulator in the full-charged final state according to the specific enthalpy value of the saturated water, the specific enthalpy value of the saturated steam, the specific volume of the saturated water, and the specific volume of the saturated steam.

Optionally, formulas for calculating the total energy of the steam and water and the total mass of the steam and water in the single steam accumulator in the full-charged final state according to the specific enthalpy value of the saturated water, the specific enthalpy value of the saturated steam, the specific volume of the saturated water, and the specific volume of the saturated steam are as follows:

$$m_a = m_{w1} + m_{g1};$$

$$H_a = H_{w1} + H_{g1};$$

$$m_{w1} = \frac{V_{w1}}{v_{w1}};$$

$$m_{g1} = \frac{V_{g1}}{v_{g1}};$$

$$H_{w1} = \frac{m_{w1}}{h_{w1}};$$

-continued $$H_{g1} = \frac{m_{g1}}{h_{g1}};$$

$$V_{w1} = \pi \times L^2 \times r_3 - \frac{\pi \times L^3}{3};$$

$$V_{g1} = V_3 - V_{w1};$$

where $H_a$ is the total energy of the steam and water in the single steam accumulator in the full-charged final state, $m_a$ is the total mass of the steam and water in the single steam accumulator in the full-charged final state, $m_{w1}$ and $m_{g1}$ are respectively the mass of the water and the mass of the steam in the single steam accumulator in the full-charged final state, and $H_{w1}$ and $H_{g1}$ are respectively the energy of the water and the energy of the steam in the single steam accumulator in the full-charged final state;

$V_{w1}$ and $V_{g1}$ are respectively the volume of the water and the volume of the steam in the single steam accumulator in the full-charged final state, and $v_{w1}$ and $v_{g1}$ are respectively the specific volume of the saturated water and the specific volume of the saturated steam in the single steam accumulator in the full-charged final state;

$h_{w1}$ and $h_{g1}$ are respectively the specific enthalpy value of the saturated water and the specific enthalpy value of the saturated steam in the single steam accumulator in the full-charged final state; and L is the liquid level height in the single steam accumulator in the full-charged final state, $r_3$ is the radius of the single steam accumulator, and $V_3$ is the volume of the single steam accumulator.

Optionally, calculating, according to the total energy of the steam and water and the total mass of the steam and water in the single steam accumulator in the full-charged final state, the mass of the heat supply steam that is capable of being provided by the single steam accumulator specifically includes:

calculating, according to the total energy of the steam and water and the total mass of the steam and water in the single steam accumulator in the full-charged final state, the mass of the heat supply steam that is capable of being provided by the single steam accumulator by using the following formula:

$$m_g = \frac{\left(m_a - \frac{m_a \times h_{g2} - H_a}{h_{g2} - h_{w2}}\right) \times v_{g2} - \left(V_3 - \frac{m_a \times h_{g2} - H_a}{h_{g2} - h_{w2}} \times v_{w2}\right)}{v_{g2}},$$

where $m_g$ is the mass of the heat supply steam that is capable of being provided by the single steam accumulator, $m_a$ is the total mass of the steam and water in the single steam accumulator in the full-charged final state, $H_a$ is the total energy of the steam and water in the single steam accumulator in the full-charged final state, $h_{w2}$ and $h_{g2}$ are respectively the specific enthalpy value of the saturated water and the specific enthalpy value of the saturated steam in the steam accumulator in the final state after steam supply, and $v_{w2}$ and $v_{g2}$ are respectively the specific volume of the saturated water and the specific volume of the saturated steam in the steam accumulator in the final state after steam supply.

Optionally, a formula for calculating the mass of the heating steam that is capable of being stored by the single steam accumulator specifically is as follows:

$$m_e = \frac{(H_a - m_a \times h_{30})}{h_2''' - h_{30}};$$

where $m_e$ is the mass of the heating steam that is capable of being stored by the single steam accumulator, $H_a$ is the total energy of the steam and water in the single steam accumulator in the full-charged final state, $m_a$ is the total mass of the steam and water in the single steam accumulator in the full-charged final state, $h_{30}$ is a specific enthalpy value of the water in the steam accumulator in an initial state, and $h_2'''$ is a specific enthalpy value of a steam extracted at the preset steam extraction position of the steam power cycle unit when the steam flows into the steam accumulator.

Optionally, a formula for calculating the flow rate of the heating molten salt by using the principle of energy conservation according to the flow rate of the heat storage steam is as follows:

$$M_2 \times (h_2' - h_2'') = M_{ms} \times (h_{hms} - h_{cms})$$

where $M_{ms}$ is the flow rate of the heating molten salt, $h_2'$ and $h_2''$ are respectively specific enthalpy values of steam flowing in and out of the steam side of the first steam-molten salt heat exchanger, and $h_{hms}$ and $h_{cms}$ are respectively specific enthalpy values of the molten salt in a second molten salt tank and a first molten salt tank, $h_{hms} > h_{cms}$.

Optionally, calculating the flow rate of the heat supply steam and the flow rate of the heat supply molten salt in the heat release stage specifically includes:

calculating the flow rate of the heat supply steam in the heat release stage by using the following formula:

$$M_g = M_{heat1};$$

where $M_g$ is the flow rate of the heat supply steam, and $M_{heat1}$ is the gap flow rate of the heat supply steam; and calculating the flow rate of the heat supply molten salt by using the principle of energy conservation according to the flow rate of the heat supply steam;

$$M_{ms}' \times (h_{hms} - h_{cms}) = M_g \times (h_{heat1} - h_3');$$

where $M_{ms}'$ is the flow rate of the heat supply molten salt, $h_{hms}$ and $h_{cms}$ are respectively the specific enthalpy values of the molten salt in the second molten salt tank and the first molten salt tank, $h_3'$ is a specific enthalpy value of preheated saturated steam, and $h_{heat1}$ is a specific enthalpy value of the heat supply steam required by the heat supply network.

Optionally, a formula for calculating the flow rate of the heat storage steam and the duration of the heat storage stage is as follows:

$$m_E = M_2 \times H_2 \times 10^3;$$

$$0 \le M_2 \le (\alpha_{max}\% \times M_{A_steam});$$

$$0 \le H_2 \le T_{A_sustain};$$

where $m_E$ is the target mass, $M_2$ is the flow rate of the heat storage steam, $H_2$ is the duration of the heat storage stage, $T_{A_sustain}$ is a maximum duration that the steam power cycle unit is in a state capable of providing steam, $M_{A_steam}$ is the flow rate of the steam at the preset steam extraction position of the steam power cycle unit, and $\alpha_{max}$ is a maximum safe extraction ratio at the preset steam extraction position.

Optionally, before entering the heat storage stage, the method further includes:

supplementing liquid water in the steam accumulator of the steam accumulator heat storage system to an initial water mass.

Optionally, before entering the heat storage stage, the method further includes:

calculating a water supplement mass according to a mass of the heat storage steam in a previous auxiliary heat supply cycle and a mass of the heat supply steam in the previous auxiliary heat supply cycle, where an auxiliary heat supply cycle includes the heat storage stage and the heat release stage; and supplementing the liquid water with the water supplement mass to the steam accumulator of the steam accumulator heat storage system.

Optionally, the real-time flow rate of the saturated steam output from the steam accumulator heat storage system to the second steam-molten salt heat exchanger is determined by a real-time flow rate of saturated steam output to the preheating system; and controlling the real-time flow rate of the saturated steam output from the steam accumulator heat storage system to the second steam-molten salt heat exchanger according to the flow rate of the heat supply steam includes:

controlling the real-time flow rate of the saturated steam output from the steam accumulator heat storage system to the preheating system according to the flow rate of the heat supply steam.

Optionally, the preheating system includes: the heater and the heat regenerator.

During a period from start of heat release by the steam accumulator heat storage system to the superheated steam starting to maintain stable, the saturated steam in the steam accumulator heat storage system flows through the heater to enter the second steam-molten salt heat exchanger, and the saturated steam flowing through the heater is preheated through the heater, enabling that a temperature of the preheated saturated steam is not lower than the solidifying point temperature of the molten salt in the molten salt heat storage system; and at a stage where the superheated steam maintains stable, the saturated steam in the steam accumulator heat storage system flows through the heat regenerator and enters the second steam-molten salt heat exchanger, and the saturated steam flowing through the heat regenerator is preheated by extracting the superheated steam from the heat supply network as a preheating heat source, enabling that the temperature of the preheated saturated steam is not lower than the solidifying point temperature of the molten salt in the molten salt heat storage system, where the steam, as the preheating heat source, flows out of the heat regenerator, and then is mixed with the superheated steam output from the second steam-molten salt heat exchanger and enters the heat supply network.

Optionally, the heater is a steam heater; during the period from the start of heat release by the steam accumulator heat storage system to the superheated steam starting to maintain stable, the saturated steam in the steam accumulator heat storage system flows through the steam heater to enter the second steam-molten salt heat exchanger, and the saturated steam flowing through the steam heater is preheated by extracting the steam from the steam power cycle unit as the preheating heat source, enabling that the temperature of the preheated saturated steam is not lower than the solidifying point temperature of the molten salt in the molten salt heat storage system.

Optionally, when the starting condition is satisfied, controlling the real-time flow rate of the saturated steam output from the steam accumulator heat storage system to the preheating system according to the flow rate of the heat supply steam specifically includes:

during the period from the start of heat release by the steam accumulator heat storage system to the superheated steam starting to maintain stable, controlling the real-time flow rate of the saturated steam output from the steam accumulator heat storage system to the heater according to the flow rate of the heat supply steam, enabling that the temperature of the preheated saturated steam is not lower than the solidifying point temperature of the molten salt in the molten salt heat storage system; and at the stage where the superheated steam maintains stable, controlling the flow rate of the saturated steam output from the steam accumulator heat storage system to the heat regenerator according to the flow rate of the heat supply steam, and controlling the flow rate of the steam extracted from the heat supply network, enabling that the temperature of the preheated saturated steam is not lower than the solidifying point temperature of the molten salt in the molten salt heat storage system.

Optionally, the preheating system further includes the bypass pipeline. The bypass pipeline is arranged between the steam outlet of the steam accumulator heat storage system and the steam side of the second steam-molten salt heat exchanger; in the heat release stage, when the starting condition is not satisfied, the bypass pipeline is conducted, and the heat regenerator and the heater are closed; and controlling the real-time flow rate of the saturated steam output from the steam accumulator heat storage system to the preheating system according to the flow rate of the heat supply steam specifically includes:

controlling the real-time flow rate of the saturated steam output from the steam accumulator heat storage system to the bypass pipeline according to the flow rate of the heat supply steam.

Optionally, the starting condition is the temperature of the saturated steam released by the steam accumulator heat storage system at the heat release stage being lower than the solidifying point temperature of the molten salt, or receiving a control command transmitted by a user for starting the preheating system, or receiving a solidifying alarm signal output by a monitoring apparatus of the molten salt heat storage system.

According to another aspect, the present disclosure further provides a computer device, including a memory, a processor, and a computer program stored in the memory and running on the processor. The processor executes the computer program to implement the above-mentioned method.

According to another aspect, the present disclosure further provides a computer-readable storage medium, which stores a computer program therein. The computer program implements the above-mentioned control method when executed by a processor.

According to another aspect, the present disclosure further provides a computer program product, including a computer program. The computer program implements the above-mentioned control method when executed by a processor.

According to specific embodiments provided in the present disclosure, the present disclosure discloses the following technical effects:

Embodiments of the present disclosure provide a steam power cycle thermoelectric decoupling system and control method. The system includes: a molten salt heat storage system, a steam accumulator heat storage system, and a preheating system. At the heat storage stage, steam may be extracted from the steam power cycle unit. The extracted steam may exchange heat with molten salt in the molten salt heat storage system (the extracted steam flows through the first steam-molten salt heat exchanger in the molten salt heat storage system, and exchanges heat with the molten salt in the first steam-molten salt heat exchanger), so that the molten salt is heated to store heat, and the heat-exchanged steam (i.e., the steam output from the steam side of the first steam-molten salt heat exchanger) is stored in the steam accumulator heat storage system. At the heat release stage, saturated steam and high-temperature molten salt respectively flow through the second steam-molten salt heat exchanger in the steam accumulator heat storage system to exchange heat. In the heat release stage, the superheated steam can be obtained by heating the stored steam in the steam accumulator heat storage system through the high-temperature molten salt obtained in the heat storage stage, and is provided to the heat supply network. This process does not require the steam power cycle unit to serve as a main supply of the superheated steam, thus enabling thermoelectric decoupling.

Further, in the technical solution provided in the embodiments of the present disclosure, at the heat storage stage, while some high-grade sensible heat of extracted steam stored in the molten salt heat storage system, the remaining medium and low-grade sensible heat and all latent heat are stored in the steam accumulator heat storage system, the stored steam can be utilized at the heat release stage, thus solving the problems of low heat storage efficiency and high heat storage costs of the molten salt faced by a conventional molten salt heat storage mode.

In addition, at the heat release stage, the saturated steam output from the steam accumulator heat storage system enters the second steam-molten salt heat exchanger through the preheating system. The preheating system may be started when the starting condition is satisfied to preheat the steam output from the steam accumulator heat storage system, enabling that the temperature of the preheated steam is not lower than the solidifying point temperature of the molten salt. This can prevent the molten salt from solidifying when the steam exchanges heat with the molten salt.

The embodiments of the present disclosure further provide a control method, device, medium, and product for the steam power cycle thermoelectric decoupling system. According to the gap flow rate of the heat supply steam and the gap duration of the heat supply steam, a control policy for the steam power cycle thermoelectric decoupling system is developed to control the steam power cycle thermoelectric decoupling system, thus solving the problem that the CHP unit cannot meet a heat supply demand and a power generation demand simultaneously when the heat supply demand does not match the power generation demand, which significantly improves operation flexibility and adaptability of the unit.

REFERENCE SIGNS IN THE DRAWINGS

1, steam power cycle unit; 11, boiler; 12, steam turbine; 13, power generator; 14, condenser; 15, condensate pump; 16, low-pressure heat regenerator; 17, oxygen extractor; 18, feedwater pump; 19, high-pressure heat regenerator; 2, molten salt heat storage system; 21, first molten salt tank; 22, first molten salt pump; 23, first steam-molten salt heat exchanger; 24, third regulating valve; 25, second molten salt tank; 26, second molten salt pump; 3, steam accumulator heat storage system; 31, fourth regulating valve; 32, steam accumulator; 33, first regulating valve; 34, second steam-molten salt heat exchanger; 35, water-charging pump; 36, first stop valve; 37, second stop valve; 38, second regulating valve; 39, heater; 40, sixth regulating valve; 4, heat supply system; 41, heat supply network; 42, heat regenerator; and 43, fifth regulating valve.

DETAILED DESCRIPTION OF THE EMBODIMENTS

An objective of the present disclosure is to provide a steam power cycle thermoelectric decoupling system, and control method, device, medium, and product thereof, so as to solve problems of low molten salt heat storage efficiency and high heat storage costs while achieving thermoelectric decoupling.

To make above objective, features, and advantages of the present disclosure more apparent and more comprehensible, the present disclosure is further described in detail below with reference to accompanying drawings and specific implementations.

Embodiment 1

Figure 1:
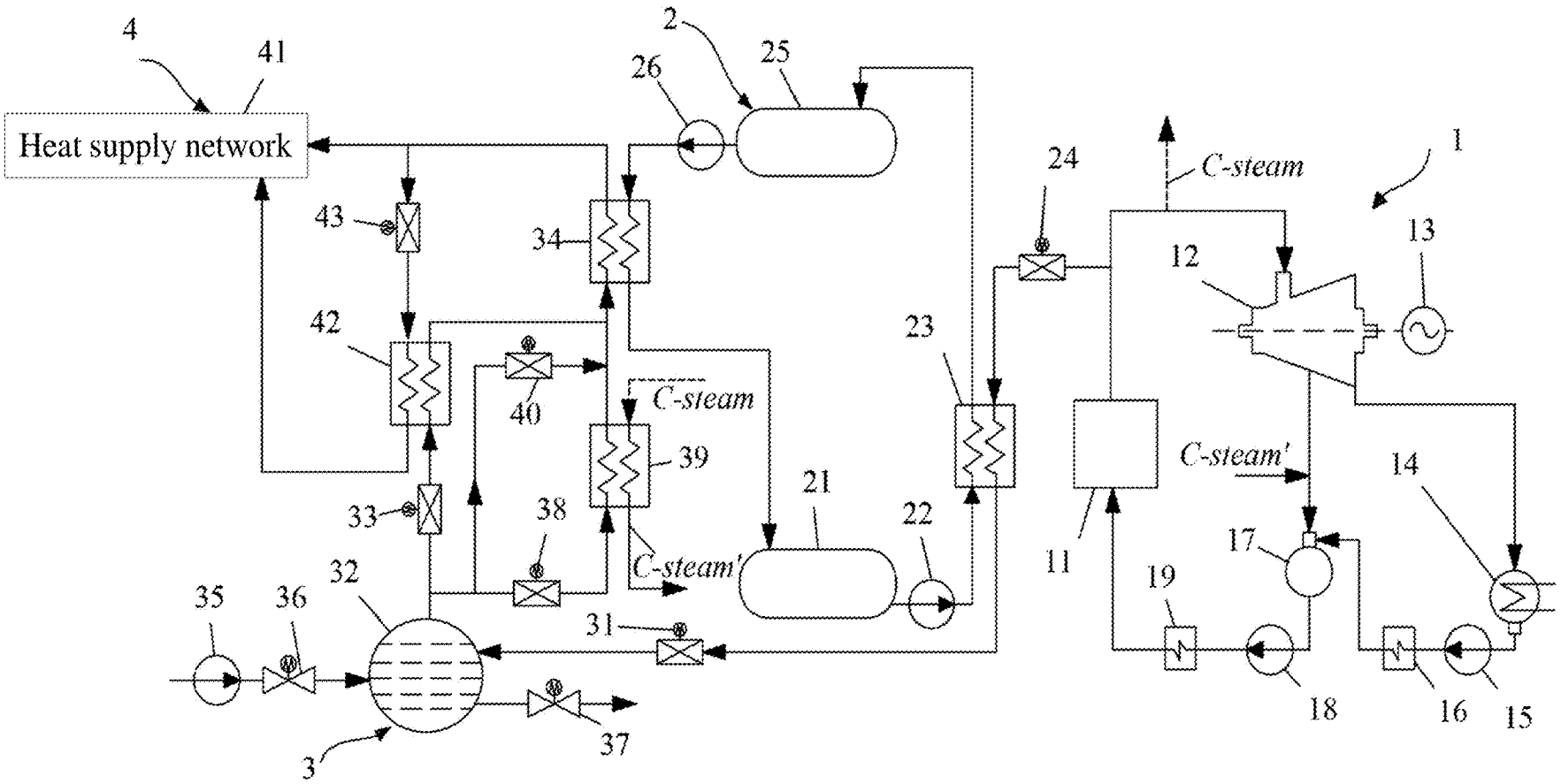
FIG. 1 is a structural diagram of a steam power cycle thermoelectric decoupling system according to an embodiment of the present disclosure.

As shown in FIG. 1, Embodiment 1 provides a steam power cycle thermoelectric decoupling system. The system includes: a molten salt heat storage system 2, a steam accumulator heat storage system 3, and a preheating system. One end of a steam side of a first steam-molten salt heat exchanger 23 of the molten salt heat storage system 2 is connected to a preset steam extraction position of a steam power cycle unit 1, and the other end of the steam side of the first steam-molten salt heat exchanger 23 is connected to a steam inlet of the steam accumulator heat storage system 3. The first steam-molten salt heat exchanger 23 is configured to heat molten salt in the molten salt heat storage system 2 by using steam extracted from the steam power cycle unit 1. A steam outlet of the steam accumulator heat storage system 3 is connected to a steam inlet of the preheating system. A steam outlet of the preheating system is connected to one end of a steam side of a second steam-molten salt heat exchanger 34 of the molten salt heat storage system 2, and the other end of the steam side of the second steam-molten salt heat exchanger 34 is connected to a heat supply network 41. The preheating system is capable of preheating saturated steam output from the steam accumulator heat storage system 3 to enable that a temperature of the preheated saturated steam is not lower than a solidifying point temperature of the molten salt in the molten salt heat storage system 2. The second steam-molten salt heat exchanger 34 is configured to heat the preheated saturated steam by using the heating molten salt in the molten salt heat storage system 2, so as to obtain superheated steam.

The steam power cycle thermoelectric decoupling system according to the present disclosure is applied to a combined heat and power (CHP) unit. The CHP unit includes the steam power cycle unit 1 and a heat supply system 4.

As an example, the steam power cycle unit 1 includes a boiler 11, a steam turbine 12, a condenser 14, a condensate pump 15, and an oxygen extractor 17, which are connected to each other in sequence, and further includes a power generator 13 connected to the steam turbine 12. A low-pressure heat regenerator 16 is arranged between the condensate pump 15 and the oxygen extractor 17, and a feed-water pump 18 and a high-pressure heat regenerator 19 are arranged between the oxygen extractor 17 and the boiler 11.

The heat supply system 4 includes a heat supply network 41.

The molten salt heat storage system 2 exemplarily includes a first molten salt tank 21, a first molten salt pump 22, a first steam-molten salt heat exchanger 23, a second molten salt tank 25, a second molten salt pump 26, and a second steam-molten salt heat exchanger 34, which are connected to each other in sequence. A steam inlet end of the first steam-molten salt heat exchanger 23 is connected to a third regulating valve 24.

The steam accumulator heat storage system 3 exemplarily includes at least one or more steam accumulators 32. In another embodiment of the present disclosure, the steam accumulator heat storage system 3 may further include auxiliary components, including, but not limited to, a fourth regulating valve 31, a first regulating valve 33, a water-charging pump 35, a first stop valve 36, and a second stop valve 37.

A water outlet end of the water-charging pump 35 is connected to a water inlet of the steam accumulator 32 through the first stop valve 36, and the second stop valve 37 is arranged at a water discharge outlet of the steam accumulator 32.

When there are a plurality of steam accumulators 32, the plurality of steam accumulators 32 may share the auxiliary components, or each steam accumulator 32 is individually equipped with the auxiliary components. Or, some of the plurality of steam accumulators 32 share the auxiliary component, and others of the plurality of steam accumulators 32 are individually equipped with the auxiliary components, which are not described herein in detail.

In an example, the above-mentioned preheating system may further include: a heater 39 and a heat regenerator 42. The heater 39 may be a steam heater, or may be replaced with an electric heater or other heating apparatus, such as a solar heater, according to requirements. The type of the heater 39 is not limited here.

Specifically, the foregoing first regulating valve 33 is arranged between a steam inlet of the heater 39 and the steam outlet of the steam accumulator heat storage system 3, and a second regulating valve 38 is arranged between a steam inlet of a secondary side of the heat regenerator 42 and the steam outlet of the steam accumulator heat storage system 3.

The first regulating valve 33 may control conduction between the heater 39 and the steam outlet of the steam accumulator heat storage system 3, and may control parameters (for example, a temperature, a pressure, and a flow rate) of the steam flowing through the heater 39 to the second steam-molten salt heat exchanger 34.

Similarly, the second regulating valve 38 may control conduction between the heat regenerator 42 and the steam outlet of the steam accumulator heat storage system 3, and may control parameters (for example, a temperature, a pressure, and a flow rate) of the steam flowing through the heat regenerator 42 to the second steam-molten salt heat exchanger 34.

When the heater 39 is the steam heater, the following configurations may be performed:

A primary side of the heater 39 is connected to the steam power cycle unit 1. A steam inlet of a secondary side of the heater 39 is connected to the steam outlet of the steam accumulator heat storage system 3, and a steam outlet of the secondary side of heater 39 is connected to one end of the steam side of the second steam-molten salt heat exchanger 34. A primary side of the heat regenerator 42 is connected to the heat supply network 41, a steam inlet of a secondary side of the heat regenerator 42 is connected to the steam outlet of the steam accumulator heat storage system 3, and a steam outlet of the secondary side of the heat regenerator 42 is connected to one side of the steam side of the second steam-molten salt heat exchanger 34.

The heater 39 is capable of preheating saturated steam output from the steam accumulator heat storage system 3 during the period from the start of heat release by the steam accumulator heat storage system 3 to the superheated steam starting to maintain stable; and the heat regenerator 42 is capable of preheating the saturated steam output from the steam accumulator heat storage system 3 at the stage where the superheated steam maintains stable.

Further, a fifth regulating valve 43 may be arranged between a steam inlet of the primary side of the heat regenerator 42 and the heat supply network 41. The fifth regulating valve 43 may control conduction of the heat regenerator 42, and control parameters (for example, a temperature, a pressure, and a flow rate) of the steam flowing through the heat regenerator 42 to the second steam-molten salt heat exchanger 34.

In another embodiment of the present disclosure, a stop valve or a check valve may be arranged at an outlet of the heater 39 and an outlet of the heat regenerator 42 in all embodiments mentioned above, so as to prevent steam from flowing back, and improve safety.

In another embodiment of the present disclosure, if the solidifying point temperature of the used molten salt is lower than a temperature of saturated steam released by the steam accumulator 32 (i. e., the starting condition of the preheating system is not met), the saturated steam output from the steam accumulator heat storage system 3 does not need to be preheated, and a bypass pipeline may be arranged in the above-mentioned preheating system to bypass the heater 39 and the heat regenerator 42. The saturated steam output from the steam accumulator heat storage system 3 may directly enter the second steam-molten salt heat exchanger 34 through the bypass pipeline.

As an example, the starting condition may be that the solidifying point temperature of the used molten salt mentioned above is higher than the temperature of the saturated steam released by the steam accumulator 32, or may be a control command transmitted by a user for starting the preheating system, or a solidifying alarm signal output by a monitoring apparatus of the molten salt heat storage system 2, or may be other conditions, which are not described herein in detail.

In an example, a sixth regulating valve 40 may also be arranged on the bypass pipeline. The sixth regulating valve 40 may control conduction of the bypass pipeline, and control parameters (for example, a temperature, a pressure, and a flow rate) of the steam flowing through the bypass pipeline and released to the second steam-molten salt heat exchanger 34.

In some embodiments, a heat insulation material may be arranged outside the steam accumulator 32, thus achieving lower energy dissipation of high-temperature hot water stored inside the steam accumulator, so as to maintain a high temperature state all the time.

To further ensure lower energy dissipation of the high-temperature hot water stored inside the steam accumulator 32, it may be considered that active heat insulation or active heating may be performed on the high-temperature hot water inside the steam accumulator 32.

In an embodiment of the present disclosure, a liquid level meter may be arranged inside the steam accumulator 32 (not shown in the figure), and the liquid level meter is configured to detect real-time water level in the steam accumulator 32.

In this embodiment, the molten salt heat storage system 2 and the steam accumulator heat storage system 3 are combined to achieve cascade full energy heat storage, and achieve high-efficiency and low-cost thermoelectric decoupling. The preheating system is arranged to address a problem that the molten salt is prone to solidifying when the saturated steam in the steam accumulator heat storage system 3 in the heat release stage is directly output to the molten salt heat storage system 2 for heating by using the preheating system in a solution in which the molten salt heat storage system 2 and the steam accumulator heat storage system 3 are combined.

Embodiment 2

Figure 2:
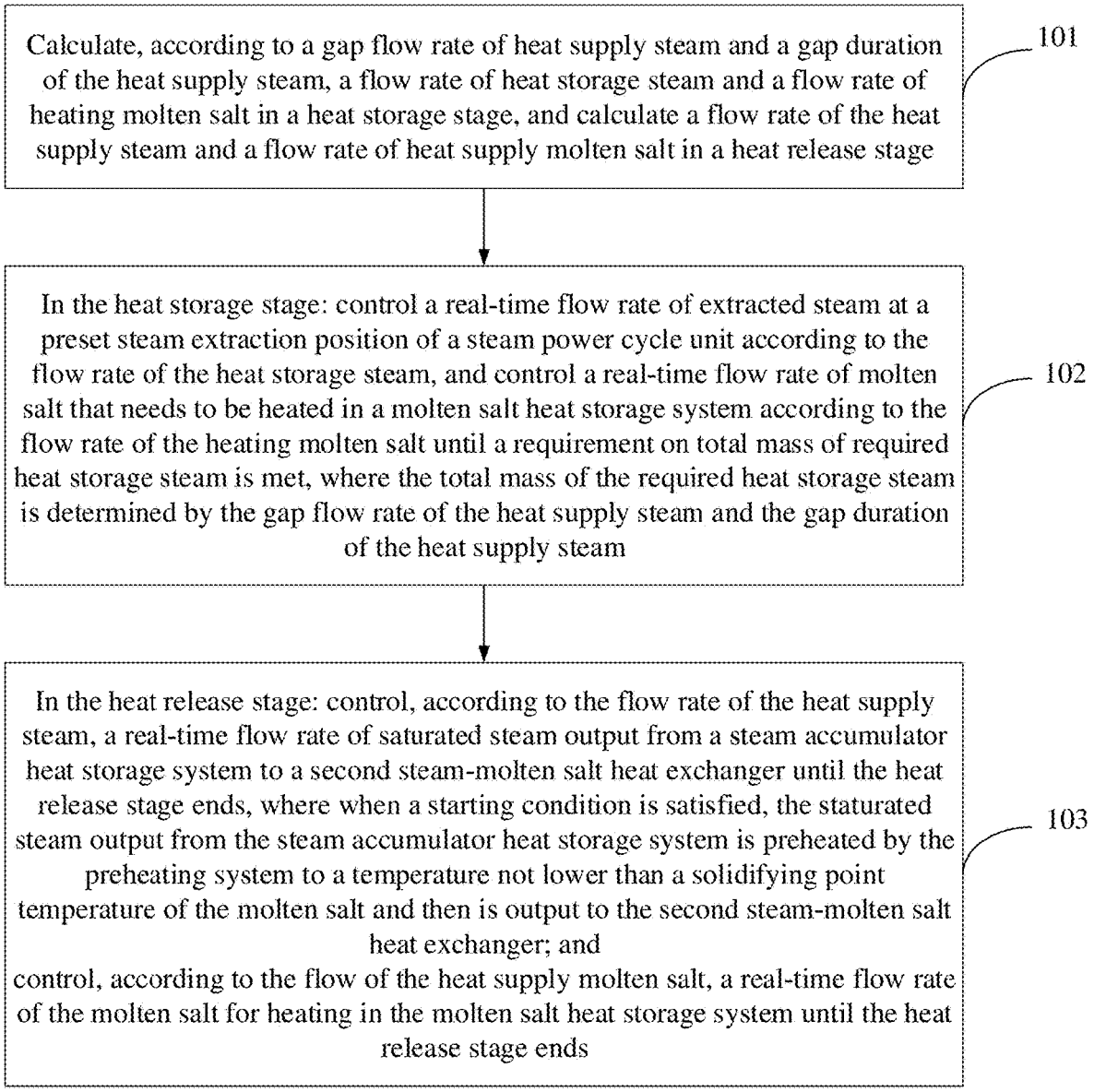
FIG. 2 is a flowchart of a control method for the steam power cycle thermoelectric decoupling system according to an embodiment of the present disclosure.

As shown in FIG. 2, this embodiment provides a control method for the steam power cycle thermoelectric decoupling system. The control method is applied to the steam power cycle thermoelectric decoupling system in Embodiment 1. The control method includes the following steps:

Step 101: according to a gap flow rate of heat supply steam and a gap duration of the heat supply steam, a flow rate of heat storage steam and a flow rate of heating molten salt in a heat storage stage are calculated, and a flow rate of the heat supply steam and a flow rate of heat supply molten salt in a heat release stage are calculated.

Step 102: in the heat storage stage:

a real-time flow rate of extracted steam at the preset steam extraction position of the steam power cycle unit 1 is controlled according to the flow rate of the heat storage steam, and a real-time flow rate of molten salt that needs to be heated in the molten salt heat storage system 2 is controlled according to the flow rate of the heating molten salt until a requirement on total mass of required heat storage steam is met, where the total mass of the required heat storage steam is determined by the gap flow rate of the heat supply steam and the gap duration of the heat supply steam.

Step 103: in the heat release stage:

according to the flow rate of the heat supply steam, a real-time flow rate of saturated steam output from the steam accumulator heat storage system 3 to the second steam-molten salt heat exchanger 34 is controlled until the heat release stage ends; where in a case that the starting condition is satisfied, the saturated steam output by the steam accumulator heat storage system 3 is preheated by the preheating system to a temperature not lower than a solidifying point temperature of the molten salt and then is output to the second steam-molten salt heat exchanger 34; for example, the starting condition can be that the solidifying point temperature of the used molten salt mentioned above is higher than the temperature of the saturated steam released by the steam accumulator 32, or can be the control command transmitted by the user for starting the preheating system, or the solidifying alarm signal output by the monitoring apparatus of the molten salt heat storage system 2, or may be other conditions, which are not described herein in detail; and according to the flow rate of the heat supply molten salt, the real-time flow rate of the molten salt for heating in the molten salt heat storage system 2 is controlled until the heat release stage ends.

In this embodiment of the present disclosure, two modes for calculating the flow rate of the heat storage steam and the flow rate of the heating molten salt are respectively provided for two different situations.

In a case that the steam accumulator heat storage system 3 includes a sufficient quantity of steam accumulators 32, the sufficient quantity herein refers to that a quantity of the steam accumulators 32 is greater than or equal to N, where a maximum heat supply demand can be met when the N steam accumulators 32 all work in a rated state. When the sufficient quantity of steam accumulators 32 may be selected to use as required, according to the gap flow rate of the heat supply steam and the gap duration of the heat supply steam, calculating the flow rate of the heat storage steam and the flow rate of the heating molten salt in the heat storage stage specifically includes: calculating a total mass of the heat supply steam according to the gap flow rate of the heat supply steam and the gap duration of the heat supply steam; calculating total energy of steam and water and a total mass of the steam and water in the single steam accumulator 32 in a full-charged final state; according to the total energy of the steam and water and the total mass of the steam and water in the single steam accumulator 32 in the full-charged final state, calculating a mass of heating steam that is capable of being stored in the single steam accumulator 32; according to the total energy of the steam and water and the total mass of the steam and water in the single steam accumulator 32 in the full-charged final state, calculating a mass of the heat supply steam that is capable of being provided by the single steam accumulator 32; according to the mass of the heat supply steam that is capable of being provided by the single steam accumulator 32 and the total mass of the heat supply steam, calculating a quantity of steam accumulators 32 required in a present auxiliary heat supply period as a target quantity, where the auxiliary heat supply period includes the heat storage stage and the heat release stage; according to the mass of the heating steam that is capable of being stored in the single steam accumulator 32, calculating a total mass of the heating steam that is capable of being stored in the target quantity of steam accumulators 32 as a target mass; calculating the flow rate of the heat storage steam and a duration of the heat storage stage according to the target mass; and calculating the flow rate of the heating molten salt by using a principle of energy conservation according to the flow rate of the heat storage steam. In this case, the full-charged final state of the steam accumulator 32 is preferably a rated state.

In a case that the steam accumulator heat storage system 3 includes one or a limited quantity of steam accumulators 32, the limited quantity herein refers to that a quantity of the steam accumulators 32 is less than the above-mentioned N, where according to the gap flow rate of the heat supply steam and the gap duration of the heat supply steam, calculating the flow rate of the heat storage steam and the flow rate of the heating molten salt in the heat storage stage specifically includes: calculating the total mass of the heat supply steam according to the gap flow rate of the heat supply steam and the gap duration of the heat supply steam; according to the total mass of the heat supply steam, determining parameters of the full-charged final state of the steam accumulator 32 satisfying a heat supply condition, where the parameters of the full-charged final state includes a pressure and a saturation temperature in the full-charged final state; according to the parameters of the full-charged final state of the steam accumulator 32 satisfying the heat supply condition, calculating the mass of the heating steam that is capable of being stored in the single steam accumulator 32 as a target mass; calculating the flow rate of the heat storage steam and a duration of the heat storage stage according to the target mass; and calculating the flow rate of the heating molten salt by using the principle of energy conservation according to the flow rate of the heat storage steam. In this case, when there are a limited quantity of steam accumulators 32, all participate in energy storage. The limited quantity of steam accumulators 32 are taken as a whole for performing calculation, that is, are equivalent to a steam accumulator 32 for performing calculation.

As an example, considering a CHP unit with a rated power generation quantity of $P_e$ MW, when the unit bears a steam supply load of $M_{heat0}$ t/h, the unit has a power generation interval of $A_{min}$ %-100%, and the unit is at $A_{min}$ % load or 100% power generation load, or shuts down or is in other conditions which cannot completely meet a heat supply steam demand of $M_{heat0}$ t/h, the gap flow rate of the heat supply steam is $M_{heat1}$ t/h, and the gap duration of the heat supply steam is $H_{heat1}$ hours, a temperature of the heat supply steam is a temperature $T_{heat1}$° C., a pressure of the heat supply steam is $P_{heat1}$ MPa, and a specific enthalpy value of the heat supply steam required by the heat supply network is $h_{heat1}$ kJ/kg.

The unit load which cannot completely meet the heat supply steam demand of $M_{heat0}$ t/h may be at any load time of the steam power cycle unit 1. A specific heat supply gap time is not limited herein.

In the two calculation modes mentioned above, a formula for calculating the total mass $m_{heat1}$ of the heat supply steam according to the gap flow rate of the heat supply steam and the gap duration of the heat supply steam is as follows:

$$m_{heat1}=M_{heat1}\times H_{heat1}\times 10^3 \quad (1)$$

Assuming that steam is extracted for heat storage at a power generation load of A %, and the extracted steam is recorded as A_steam, the duration $H_2$ of the heat storage stage, and the flow rate $M_2$ t/h and the pressure $P_2$ MPa of the extracted steam need to satisfy the following condition:

$$A_{min}<A<100 \quad (2)$$

$$m_E=M_2\times H_2\times 10^3 \quad (3)$$

$$0\leq M_2\leq(\alpha_{max}\%\times M_{A_steam}) \quad (4)$$

$$0\leq H_2\leq T_{A_sustain} \quad (5)$$

$$P_2>P_{heat1}+P_{loss} \quad (6)$$

where $m_E$ is the target mass, $M_2$ is the flow rate of the heat storage steam, $H_2$ is the duration of the heat storage stage, $T_{A_sustain}$ is a maximum duration that the steam power cycle unit 1 is in a state capable of providing steam, $M_{A_steam}$ is the flow rate of the steam at the preset steam extraction position of the steam power cycle unit, and $\alpha_{max}$ is a maximum safe extraction ratio at the preset steam extraction position. The constraint formula (2) represents an intermediate load stage A %, in which the unit steam is sufficient and excess, selected in the heat storage stage; in the constraint formula (4), $\alpha_{max}$ is a maximum ratio of steam that may be extracted from this stream in a case of ensuring unit safety, for example, the maximum ratio of main steam extraction is generally 10%, $M_{A_steam}$ is the flow rate of a selected steam when the unit performs steam extraction heat storage at the power generation load of A %, in a unit of t/h, and mass loss of the steam in the pipeline is ignored; in the constraint formula (5), $T_{A_sustain}$ is the operation duration of the unit at the power generation load of A %, in a unit of h; and in the constraint formula (6), $P_{loss}$ is pressure loss of the steam in the thermoelectric decoupling system, in a unit of Mpa, and this value may be calculated according to an actual application situation.

Further, the extracted steam A_steam may be any stream of steams in the steam power cycle unit 1, which may be from main steam, hot reheat steam, cold reheat steam, and steam extraction of the steam turbine 12. A specific steam extraction source is not limited herein.

Considering a cascade heat storage process of the extracted steam, first, a high-parameter steam A_steam exchanges heat with low-temperature molten salt, heat exchange loss is ignored, there are the following equilibrium equations (7)-(9) according to energy conservation for calculating the flow rate and mass of the molten salt that may be heated:

$$\Delta Q_{A_steam}=\Delta Q_{ms} \quad (7)$$

$$M_2\times(h_2'-h_2'')=M_{ms}\times(h_{hms}-h_{cms}) \quad (8)$$

$$m_{ms}=M_{ms}\times H_2 \quad (9)$$

where $h_2'$ and $h_2''$ are respectively specific enthalpy values of the steam flowing in and out of the steam side of the first steam-molten salt heat exchanger, kJ/kg; $M_{ms}$ is the flow rate of the heating molten salt, t/h; and $h_{hms}$ and $h_{cms}$ are respectively specific enthalpy values of the molten salt in a second molten salt tank and a first molten salt tank, kJ/kg, $h_{hms}>h_{cms}$.

The difference between the above two calculation modes lies in calculation of the target mass. In the first calculation mode, the target mass is obtained as follows:

a specific enthalpy value of saturated water, a specific enthalpy value of saturated steam, a specific enthalpy value of the saturated water, and a specific volume of the saturated steam in the single steam accumulator 32 in the full-charged final state are determined in a mode of searching a steam enthalpy-entropy table according to a rated pressure and a saturation temperature corresponding to the rated pressure; and the total energy and total mass of the steam and water in the single steam accumulator 32 in the full-charged final state are calculated by using the following formulas according to the specific enthalpy value of the saturated water, the specific enthalpy value of the saturated steam, the specific enthalpy value of the saturated steam, and the specific volume of the saturated steam in the single steam accumulator 32 in the full-charged final state.

$$m_a = m_{w1} + m_{g1};$$

$$H_a = H_{w1} + H_{g1};$$

$$m_{w1} = \frac{V_{w1}}{v_{w1}};$$

$$m_{g1} = \frac{V_{g1}}{v_{g1}};$$

$$H_{w1} = \frac{m_{w1}}{h_{w1}};$$

$$H_{g1} = \frac{m_{g1}}{h_{g1}};$$

$$V_{w1} = \pi \times L^2 \times r_3 - \frac{\pi \times L^3}{3};$$

$$V_{g1} = V_3 - V_{w1};$$

where $H_a$ is the total energy of the steam and water in the single steam accumulator in the full-charged final state, $m_a$ is the total mass of the steam and water in the single steam accumulator in the full-charged final state, $m_{w1}$ and $m_{g1}$ are respectively the mass of the water and the mass of the steam in the single steam accumulator in the full-charged final state, and $H_{w1}$ and $H_{g1}$ are respectively the energy of the water and the energy of the steam in the single steam accumulator in the full-charged final state;

$V_{w1}$ and $V_{g1}$ are respectively the volume of the water and the volume of the steam in the single steam accumulator in the full-charged final state, and $v_{w1}$ and $v_{g1}$ are respectively the specific volume of the saturated water and the specific volume of the saturated steam in the single steam accumulator in the full-charged final state;

$h_{w1}$ and $h_{g1}$ are respectively the specific enthalpy value of the saturated water and the specific enthalpy value of the saturated steam in the single steam accumulator in the full-charged final state; and L is a liquid level height in the single steam accumulator in the full-charged final state, $r_3$ is a radius of the single steam accumulator, and $V_3$ is a volume of the single steam accumulator.

After the steam accumulator 32 supplies steam, a final state pressure $P_{d2}$ MPa is equal to a steam supply pressure $P_{heat1}$ Mpa, a corresponding saturation temperature is $T_{d2}$° C., the specific enthalpy value of the saturated water is $h_{w2}$ kJ/kg, the specific enthalpy value of the saturated steam is $h_{g2}$ kJ/kg, the specific volume of the saturated water is $v_{w2}$ $m^3$/kg, and the specific volume of the saturated steam is $V_{g2}$ $m^3$/kg.

According to the total energy and total mass of the steam and water in the single steam accumulator 32 in the full-charged final state, the mass of the heat supply steam that is capable of being provided by the single steam accumulator 32 may be calculated by using the following formula:

$$m_g = \frac{\left(m_a - \frac{m_a \times h_{g2} - H_a}{h_{g2} - h_{w2}}\right) \times v_{g2} - \left(V_3 - \frac{m_a \times h_{g2} - H_a}{h_{g2} - h_{w2}} \times v_{w2}\right)}{v_{g2}};$$

where $m_g$ is the mass of the heat supply steam that is capable of being provided by the single steam accumulator, $m_a$ is the total mass of the steam and water in the single steam accumulator in the full-charged final state, $H_a$ is the total energy of the steam and water in the single steam accumulator in the full-charged final state, $h_{w2}$ and $h_{g2}$ are respectively the specific enthalpy value of the saturated water and the specific enthalpy value of the saturated steam in the steam accumulator in a final state after steam supply, and $v_{w2}$ and $v_{g2}$ are respectively the specific volume of the saturated water and the specific volume of the saturated steam in the steam accumulator in the final state after steam supply.

Further, if there are X (X is greater than 1 and is a positive integer) steam accumulators 32 in an actual application, the quantity X is calculated based on a rounding up principle by using the following formula.

$$X = m_{heat1}/m_g.$$

A product of the mass and quantity of the heating steam that is capable of being stored by the single steam accumulator 32 is calculated to obtain the target mass.

In the second calculation mode, the target mass may be obtained in the following mode:

In the steam accumulator 32, an initial water mass is $m_{30}$ kg, an initial water pressure is $P_{30}$ Mpa, a temperature is $T_{30}$° C., and a corresponding specific enthalpy value is $h_{30}$ kJ/kg. By searching the steam enthalpy-entropy table, a saturation temperature for the rated pressure $P_{d1}$ Mpa of a corresponding accumulator is $T_{d1}$° C., the specific enthalpy value of the saturated water is $h_{w1}$ kJ/kg, the specific enthalpy value of the saturated steam is $h_{g1}$ kJ/kg, the specific volume of the saturated water is $v_{w1}$ $m^3$/kg, and the specific volume of the saturated steam is $V_{g1}$ $m^3$/kg. A constraint condition of the pressure $P_{d1}$ in the full-charged final state is as shown in formula (10), and the liquid level height L is calculated by the following formula (11):

$$P_{heat1} + P_{loss}' + 0.1 < P_{d1} < P_2 \quad (10)$$

$$L = \sqrt{\beta} \times 2r_3 \quad (11)$$

where, in the constraint formula (10), $P_{loss}'$ is a pipeline pressure loss in the heat release stage, Mpa; in the calculation formula (11), L is the liquid level height of the steam accumulator in the final state, m; and p is a maximum liquid level ratio for a spherical tank design, which may be determined according to an actual design, with a range from 0.7 to 0.8, and is not limited herein. Or, the final state liquid level height may be also measured according to an actual liquid level when a rated storage pressure $P_{d1}$ Mpa is operated actually, and this liquid level is controlled by feedback.

A full-charged final state pressure satisfying the above constraint conditions is set, and the following calculation is performed:

obtaining the specific volume of the saturated water, the specific volume of the saturated steam, the specific enthalpy value of the saturated water, and the specific enthalpy value of the saturated steam in the single steam accumulator 32 in the full-charged final state in a mode of searching the steam enthalpy-entropy table according to the parameters in the full-charged final state;

calculating a volume $V_{w1}$ of water in the steam accumulator in the full-charged final state, $m^3$ as: $V_{w1} = \pi \times L^2 \times r_3 - \pi \times L^3/3$;

calculating a volume $V_{g1}$ of steam in the steam accumulator in the full-charged final state, $m^3$ as: $V_{g1} = V_3 - V_{w1}$;

calculating a mass $m_{w1}$ of the water in the steam accumulator in the full-charged final state, kg as: $m_{w1} = V_{w1}/v_{w1}$.

calculating a mass $m_{g1}$ of the steam in the steam accumulator in the full-charged final state, kg as: $m_{g1} = v_{g1}/v_{g1}$;

calculating a total mass $m_a$ of the steam and water in the steam accumulator in the full-charged final state, kg as: $m_{w1}+m_{g1}$;

calculating energy $H_{w1}$ of the water in the steam accumulator in the full-charged final state, kJ as: $H_{w1}=m_{w1}/h_{w1}$;

calculating energy $H_{g1}$ of the steam in the steam accumulator in the full-charged final state, kJ as: $H_{g1}=m_{g1}/h_{g1}$;

calculating total energy $H_a$ of the steam and water in the steam accumulator in the full-charged final state, kJ as: $H_a=H_{w1}+H_{g1}$;

calculating a mass of heat supply steam that is capable of being provided by the single steam accumulator 32 as:

$$m_g = \frac{\left(m_a - \frac{m_a \times h_{g2} - H_a}{h_{g2} - h_{w2}}\right) \times v_{g2} - \left(V_3 - \frac{m_a \times h_{g2} - H_a}{h_{g2} - h_{w2}} \times v_{w2}\right)}{v_{g2}}; \text{ and}$$

determining whether the heat supply condition $m_g \geq m_{heat1}$ is satisfied; when the heat supply condition is not satisfied, adjusting the full-charged final state pressure, and repeating the above calculations until the full-charged final state pressure satisfying the heat supply condition is obtained.

In the above formulas, $m_g$ is the mass of the heat supply steam that is capable of being provided by the single steam accumulator, $m_{heat1}$ is the total mass of the heat supply steam, $m_a$ is the total mass of the steam and water in the single steam accumulator in the full-charged final state, $H_a$ is the total energy of the steam and water in the single steam accumulator in the full-charged final state, $h_{w2}$ and $h_{g2}$ are respectively the specific enthalpy value of the saturated water and the specific enthalpy value of the saturated steam in the steam accumulator in the final state after steam supply, $v_{w2}$ and $v_{g2}$ are respectively the specific volume of the saturated water and the specific volume of the saturated steam in the steam accumulator in the final state after steam supply; $m_{w1}$ and $m_{g1}$ are respectively the mass of the water and the mass of the steam in the single steam accumulator in the full-charged final state, and $H_{w1}$ and $H_{g1}$ are respectively the energy of the water and the energy of the steam in the single steam accumulator in the full-charged final state; $V_{w1}$ and $V_{g1}$ are respectively the volume of the water and the volume of the steam in the single steam accumulator in the full-charged final state, and $v_{w1}$ and $v_{g1}$ are respectively the specific volume of the saturated water and the specific volume of the saturated steam in the single steam accumulator in the full-charged final state; $h_{w1}$ and $h_{g1}$ are respectively the specific enthalpy value of the saturated water and the specific enthalpy value of the saturated steam in the single steam accumulator in the full-charged final state; L is the liquid level height in the single steam accumulator in the full-charged final state, $r_3$ is the radius of the single steam accumulator, and $V_3$ is the volume of the single steam accumulator.

The mass of the heating steam that is capable of being stored by the single steam accumulator 32 is calculated as: $m_e=(H_a-m_a \times h_{30})/h_2'''-h_{30}$, where $m_e$ is the mass of the heating steam that is capable of being stored by the single steam accumulator, $H_a$ is the total energy of the steam and water in the single steam accumulator in the full-charged final state, $m_a$ is the total mass of the steam and water in the single steam accumulator in the full-charged final state, $h_{30}$ is a specific enthalpy value of the water in the steam accumulator in an initial state, and $h_2'''$ is a specific enthalpy value of a steam extracted at the preset steam extraction position of the steam power cycle unit when the steam flows into the steam accumulator.

For the heat release stage, the flow rate $M_g$ t/h of the saturated steam B_steam released by the steam accumulator 32 is directly determined by the flow rate $M_{heat1}$ t/h of the heat supply steam, that is, $M_g=M_{heat1}$.

Considering a cascade heat release process, the saturated steam B_steam released by the steam accumulator 32 is heated through high-temperature molten salt, heat exchange loss is ignored, there are the following equilibrium equations (12)-(15) according to energy conservation for calculating the flow rate $M_{ms}'$ t/h of the molten salt and the mass $m_{ms}'$ kg of the molten salt required for heating the saturated steam to steam supply parameters:

$$\Delta Q_{ms}' = \Delta Q_{B_steam} \tag{12}$$

$$M_{ms}' \times (h_{hms} - h_{cms}) = M_g \times (h_{heat1} - h_3') \tag{13}$$

$$m_{ms}' = M_{ms}' \times H_{heat1} \tag{14}$$

$$m_{ms}' = m_{ms} \tag{15}$$

where $M_{ms}'$ is the flow rate of the heat supply molten salt, $h_{hms}$ and $h_{cms}$ are respectively the specific enthalpy values of the molten salt in the second molten salt tank and the first molten salt tank, kJ/kg, $h_3'$ is a specific enthalpy value of the preheated saturated steam, kJ/kg, $h_{heat1}$ is a specific enthalpy value of the heat supply steam required by the heat supply network, kJ/kg, and $H_{heat1}$ is a steam supply gap duration that the thermoelectric decoupling system needs to satisfy, h.

As an example, specific implementation steps of step 102 and step 103 in this embodiment of the present disclosure are as follows:

(1) When the heat storage stage starts (assuming the power generation load is A %), if there are X (X is greater than 1 and is a positive integer) steam accumulators 32 in an actual application, the X steam accumulators 32 are in a series connection relationship in the heat storage process and the heat release process, and sequentially carry out the heat storage process for extracting steam and the heat release process for releasing steam. In a further embodiment, the total mass of the saturated steam that is capable of being provided by the single steam accumulator 32 is calculated, then the quantity of the required steam accumulators 32 is calculated, the total mass of the extracted steam of the X steam accumulators 32 (i.e., the foregoing target mass) is calculated, and next, the total steam extraction duration (i.e., the duration of the heat storage stage) and steam extraction flow rate (i.e., the flow rate of the heat storage steam) of the steam accumulator 32 are calculated in combination with formulas (3)-(6). The steam extraction flow rate is controlled through the third regulating valve 24, so that a temperature of the extracted steam is reduced to an upper limit of a molten salt high-temperature use requirement after passing through the first steam-molten salt heat exchanger 23, that is, the saturated steam at this temperature is not lower than the solidifying point temperature of the molten salt after being preheated.

(2) The flow rate and pressure of the molten salt that needs to be heated are controlled through the first molten salt pump 22, so that the flow rate is equal to the flow rate $M_{ms}$ t/h of the heating molten salt calculated by formula (8).

(3) The fourth regulating valve 31 controls a temperature of steam entering the steam accumulator 32 to be lower than an upper temperature limit which the steam accumulator 32 and its pipeline can bear, to obtain the specific enthalpy value $h_2'''$ kJ/kg.

(4) When the steam accumulator 32 is full-charged after the previous three steps continue for $H_2$ hours, the third regulating valve 24 is closed, the first molten salt pump 22 is shut down, the fourth regulating valve 31 is closed, and the heat storage stage ends.

(5) When the heat release stage (assuming that the power generation load is $A_{min}$ % or 100%) starts, the second regulating valve 38 controls the saturated steam B_steam at the outlet of the steam accumulator 32, with the flow rate of $M_{heat1}$ t/h, the pressure of $P_{heat1}$ Mpa, a corresponding specific enthalpy value of $h_3'$ kJ/kg, and to flow into the heater 39. The saturated steam is preheated through the steam extracted from the steam power cycle unit 1 to obtain preheated saturated steam, that is, during the period from the start of heat release by the steam accumulator heat storage system 3 to the superheated steam starting to maintain stable, a flow rate of the saturated steam output from the steam accumulator heat storage system 3 to the heater is controlled according to the flow rate of the heat supply steam, the flow rate of the steam extracted from the steam power cycle unit 1 by the heater is controlled, the saturated steam output from the steam accumulator heat storage system 3 is preheated through the steam extracted from the steam power cycle unit 1, which enables that a temperature of the preheated saturated steam is not lower than the solidifying point temperature of the molten salt in the molten salt heat storage system 2, where the flow rate of the steam extracted from the steam power cycle unit 1 is calculated according to the principle of energy conservation.

(6) The pressure of the molten salt and the flow rate $M_{ms}'$ t/h of the molten salt in the heat release process are controlled through the second molten salt pump 26.

(7) According to the principle of energy conversation, after the preheated saturated steam is heated to superheated steam satisfying the steam supply parameters in the second steam-molten salt heat exchanger 34, the superheated steam is fed into the heat supply network. After continuing for a certain time, i.e., after the second steam-molten salt heat exchanger 34 can stably output the superheated steam, the second regulating valve 38 is closed, the first regulating valve 33 is opened, and the saturated steam at the outlet of the steam accumulator 32 is controlled to flow into the heat regenerator 42. The saturated steam is heated through the steam extracted from the heat supply network 41. After the heat release duration satisfies $H_{heat1}$ hours, the first regulating valve 33 and the second molten salt pump 26 are closed, and the heat release stage ends. In other words, at the stage where the superheated steam maintains stable, the flow rate of the saturated steam output from the steam accumulator heat storage system 3 to the heat regenerator 42 is controlled according to the flow rate of the heat supply steam, the flow rate of the steam extracted from the heat supply network 41 by the heat regenerator 42 is controlled, and the saturated steam output from the steam accumulator heat storage system 3 is preheated through the steam extracted from the heat supply network 41, which enables that the temperature of the preheated saturated steam is not lower than the solidifying point temperature of the molten salt in the molten salt heat storage system 2, and the flow rate of the molten salt for heating in the molten salt heat storage system 2 is controlled according to the flow rate of the heat supply molten salt, where the flow rate of the steam extracted from the heat supply network 41 is calculated according to the principle of energy conservation.

(8) Before the start of a next heat storage stage, the first stop valve 36 and the water-charging pump 35 are opened, a water supplement mass $m_{loss}$ kg is calculated, liquid water in the steam accumulator 32 is supplemented to the initial water mass $m_{30}$ kg; or initial parameters of the liquid water are corrected according to post-steam supply final state parameters of the steam accumulator 32 after a previous heat release stage ends, and then a calculation about a next auxiliary heat supply period is performed.

For example, in an embodiment of the present disclosure, taking a CHP unit of 1000 MW as an example, the unit is responsible for industrial steam supply of 200 t/h. To ensure full load power generation at a power generation peak stage, the unit can only provide steam of 50 t/h, resulting in a steam supply gap of 150 t/h. To ensure deep peak regulation of 30% load of the unit at a power generation valley stage, the steam pressure is lower than 2.0 MPa, which cannot meet the steam supply parameters, and there is also a steam supply gap of 150 t/h. Therefore, a work technology route of the thermoelectric decoupling system proposed in the present disclosure is that: at an intermediate load stage where the unit has excess steam, the main steam is extracted for heating the molten salt to store part sensible heat, and the main steam after heat exchange is injected into the steam accumulator 32 to store remaining sensible heat and all latent heat, so that the cascade full energy heat storage is achieved, and a heat storage duration is 8 hours. The heat release stage includes the peak stage and the deep regulation stage of the unit. Industrial steam at 360° C. and 2.7 MPa is generated through cascade heat release of the steam accumulator 32 and the molten salt, and the heat release duration is 6 hours, which respectively meets steam supply of 150 t/h for three hours at the peak stage and steam supply of 150 t/h for three hours at the deep regulation stage. The total heat storage capacity of the thermoelectric decoupling system is 396 MWh, in which the heat storage capacity of the molten salt system is only 45 MWh, and the heat storage capacity of the steam accumulator heat storage system 3 is 351 MWh, accounting for 88.6% of the total heat storage capacity. Annual income includes steam supply income, peak regulation income, and peak income. According to specific situations of the project location, the annual income is about 54.7 million yuan in total; and assuming that an operation period is 25 years, a total investment payback period of the project is approximately 5.45 years.

When the steam supply pressure is relatively low at 2.7 MPa, and binary molten salt (solar salt) is applied simultaneously, the saturation temperature corresponding to the saturated steam B_steam at the outlet of the steam accumulator 32 is 228° C., which is lower than a minimum heat exchange temperature 245° C. of the binary molten salt (solar salt), resulting in that high-temperature molten salt in the second steam-molten salt heat exchanger 34 has a solidification risk, thus satisfying the starting condition.

Therefore, the present disclosure provides the steam power cycle thermoelectric decoupling system as shown in FIG. 1. A specific implementation is as follows:

As shown in FIG. 1, when the heat release stage of the thermoelectric decoupling system starts, the second regulating valve 38 is firstly opened, an appropriate high-parameter steam C_steam is extracted from the steam power cycle unit 1, and passes through the heater 39 to preheat the released saturated steam of 228° C. to 245° C. The preheated saturated steam is fed into the second steam-molten salt heat exchanger 34 for superheating, and then is fed into the heat supply network 41 after reaching 383° C. The steam C_steam' exiting the heater 39 is returned to a steam inlet end of the oxygen extractor 17 of the steam power cycle unit 1.

Secondly, after the heat supply steam of 383° C. is stable, the fifth regulating valve 43 is opened, and the first regulating valve 33 is opened while the second regulating valve 38 is closed. A portion of the steam of 383° C. is extracted from the heat supply network 41 to the heat regenerator 42 for preheating the released saturated steam of 228° C. to 245° C., and then the preheated saturated steam is fed into the second steam-molten salt heat exchanger 34 for superheating. The steam of 383° C. is reduced to 250° C. after exiting the heat regenerator 42, and is mixed with the steam of 383° C. at the outlet of the second steam-molten salt heat exchanger 34. After reaching 360° C., the mixed steam is fed into the heat supply network 41.

Thirdly, the stable operating state is to maintain the valve closing/opening states in the preceding step, a heat regeneration cycle is maintained to preheat the steam at the outlet of the steam accumulator 32, thereby avoiding the high-temperature molten salt solidifying.

When the saturation temperature corresponding to the saturated steam B_steam at the outlet of the steam accumulator 32 is not lower than the minimum heat exchange temperature of the molten salt in the second molten salt tank 25, that is, the high-temperature molten salt in the second steam-molten salt heat exchanger 34 does not have the solidification risk, that is, the starting condition is not satisfied, the saturated steam is directly released through the sixth regulating valve 40 to the second steam-molten salt heat exchanger 34 for heating in the heat release stage, so as to bypass the heater 39 and the heat regenerator 42.

Embodiment 3

A computer device includes a memory, a processor, and a computer program that is stored on the memory and operates on the processor. The processor executes the computer program to implement the control method in Embodiment 2.

Figure 3:
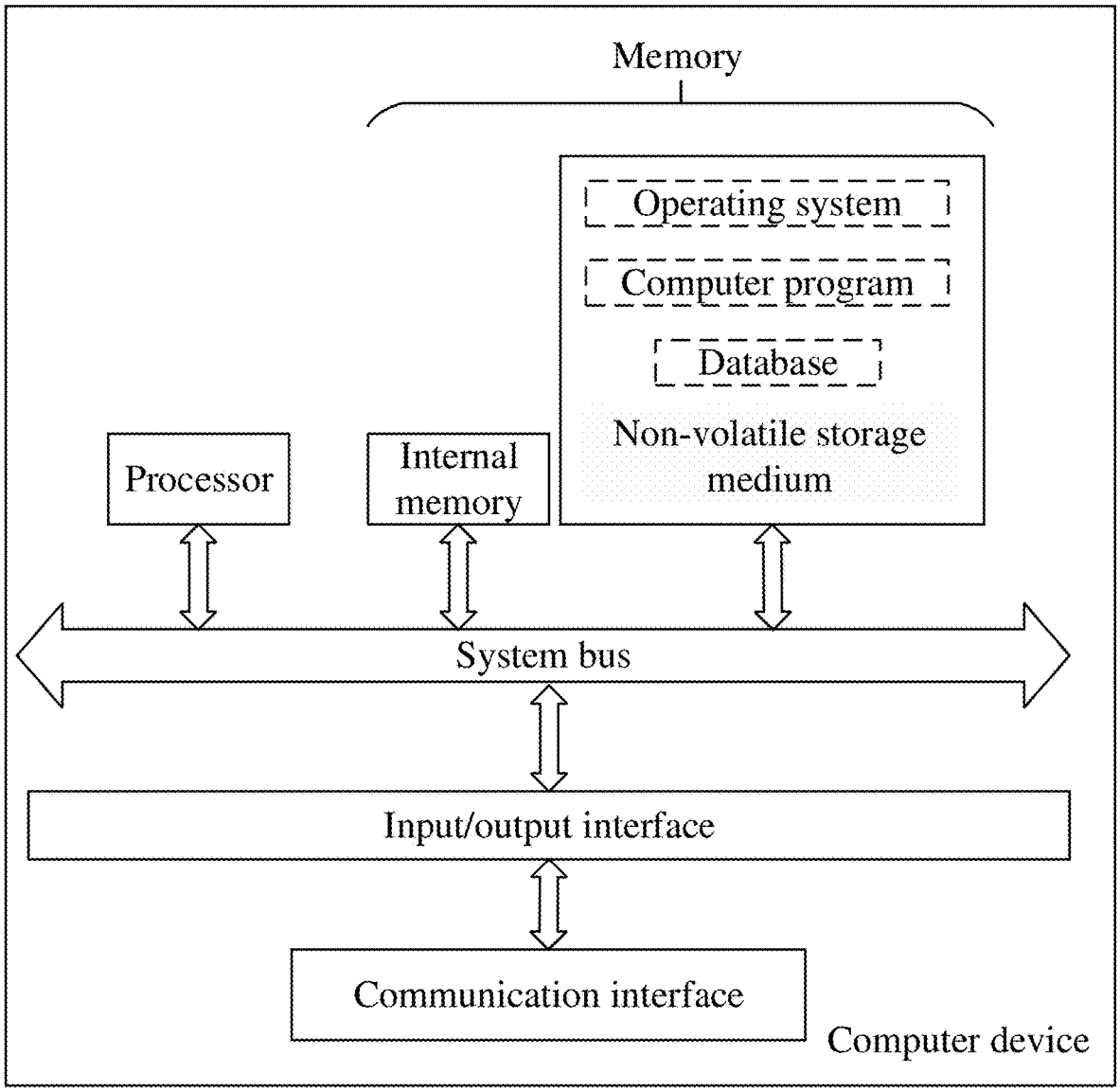
FIG. 3 is an internal structure diagram of a computer device according to an embodiment of the present disclosure.

The computer device may be a database, and its internal structure diagram may be shown in FIG. 3. The computer device includes a processor, a memory, an Input/Output (abbreviated as I/O) interface, and a communication interface. The processor, the memory, and the I/O interface are connected with each other through a system bus. The communication interface is connected to the system bus through the I/O interface. The processor of the computer device is configured to provide computing and control capabilities. The memory of the computer device includes a non-volatile storage medium and an internal memory. The non-volatile storage medium stores an operating system, a computer program, and a database. The internal memory provides an environment for running the operating system and the computer program in the non-volatile storage medium. The database of the computer device is configured to store transactions to be processed. The I/O interface of the computer device is configured to exchange information between the processor and an external device. The communication interface of the computer device is configured to communicate with an external terminal through a network connection. The computer program implements the control method in Embodiment 2 when executed by the processor.

Embodiment 4

According to another aspect, the present disclosure further provides a computer-readable storage medium, which stores a computer program therein. The computer program implements the control methods described in all the above-mentioned embodiments when executed by a processor.

Embodiment 5

A computer program product includes a computer program. The computer program implements the control methods described in all the above-mentioned embodiments when executed by a processor.

Compared with other prior arts, the technology provided in this embodiment of the present disclosure also has advantages.

For example, the invention patent CN 117029081A, published on Nov. 10, 2023, relates to a thermoelectric decoupling system for a combined cycle unit based on multistage heat storage and an operation method thereof. The system can store waste heat from gas turbine flue gas at a non-deep peak regulation stage. When new energy output is high, and the unit needs to regulate a peak deeply, the stored heat is released to the heat supply system 4 to enhance a thermoelectric decoupling capability of the combined cycle heat supply unit. However, the flue gas of this system has a relatively low temperature of the waste heat, and is only applicable to a scenario in which a heat supply demand is hot water, but is not applicable to most CHP units with a heat supply demand of steam. This system does not consider a case that a CHP unit with a gas-steam combined cycle has no flue gas waste heat for use, either.

In comparison, according to the technical solution provided by the embodiments of the present disclosure, a mode of extracting steam to heat molten salt and directly storing the steam is adopted for heat storage, which solves the above problems.

Those skilled in the art can understand that all or part of the processes in the above method embodiments may be implemented by a computer program instructing related hardware, and the computer program may be stored in a non-volatile computer-readable storage medium. The computer program, when executed, can include the process of each method embodiment as described above. Any reference to a memory, a database, or other media used in various embodiments provided in the present disclosure may include at least one of a non-volatile memory and a volatile memory. The non-volatile memory may include a Read-Only Memory (ROM), a magnetic tape, a floppy disk, a flash memory, an optical memory, a high-density embedded non-volatile memory, a resistive Random Access Memory (ReRAM), a Magnetoresistive Random Access Memory (MRAM), a Ferroelectric Random Access Memory (FRAM), a Phase Change Memory (PCM), a graphene memory, and the like. The volatile memory may include a Random Access Memory (RAM), an external cache memory, and the like. As illustration but not limitation, the RAM may be in a variety of forms such as a Static Random Access Memory (SRAM) or a Dynamic Random Access Memory (DRAM), etc. The database involved in various embodiments provided in the present disclosure may include at least one of a relational database or a non-relational database. The non-relational database may include, but is not limited to, a blockchain-based distributed database, and the like. The processor involved in various embodiments provided in the present disclosure may be, but is not limited to, a general-purpose processor, a central processing unit, a graphics processing unit, a digital signal processor, a programmable logic device, and the like, but is not limited thereto.

Technical features of the above embodiments may be arbitrarily combined. For the sake of description brevity, all possible combinations of the technical features in the above embodiments are not described. However, as long as there is no contradiction in the combination of these technical features, it is considered to be within a scope recorded in this specification.

Herein, specific examples are used for describing principles and implementations of the present disclosure. The description of the embodiments above is merely intended to help understand the method and core idea of the present disclosure. In addition, those of ordinary skill in the art may make modifications with respect to specific implementations and application scopes based on the idea of the present disclosure. In conclusion, the content of this specification is not to be construed as a limitation to the present disclosure.

What is claimed is:

1. A control method for a steam power cycle thermoelectric decoupling system, wherein the steam power cycle thermoelectric decoupling system comprises a molten salt heat storage system, a steam accumulator heat storage system, and a preheating system, wherein one end of a steam side of a first steam-molten salt heat exchanger of the molten salt heat storage system is connected to a preset steam extraction position of a steam power cycle unit, and the other end of the steam side of the first steam-molten salt heat exchanger is connected to a steam inlet of the steam accumulator heat storage system; the first steam-molten salt heat exchanger is configured to heat molten salt in the molten salt heat storage system by using steam extracted from the steam power cycle unit; and the steam accumulator heat storage system is at least configured to store steam output from the steam side of the first steam-molten salt heat exchanger;

a steam outlet of the steam accumulator heat storage system is connected to a steam inlet of the preheating system, a steam outlet of the preheating system is connected to one end of a steam side of a second steam-molten salt heat exchanger of the molten salt heat storage system, and the other end of the steam side of the second steam-molten salt heat exchanger is connected to a heat supply network; and the preheating system is capable of preheating saturated steam output from the steam accumulator heat storage system to enable that a temperature of the preheated saturated steam is not lower than a solidifying point temperature of the molten salt in the molten salt heat storage system, and wherein the saturated steam flowing through the second steam-molten salt heat exchanger is heated by the heated molten salt in the molten salt heat storage system to form superheated steam;

wherein the preheating system comprises a heater and a heat regenerator;

a steam inlet of the heater is connected to the steam outlet of the steam accumulator heat storage system, and a steam outlet of the heater is connected to the end of the steam side of the second steam-molten salt heat exchanger;

a primary side of the heat regenerator is connected to the heat supply network, a steam inlet of a secondary side of the heat regenerator is connected to the steam outlet of the steam accumulator heat storage system, and a steam outlet of the secondary side of the heat regenerator is connected to the end of the steam side of the second steam-molten salt heat exchanger;

the heater is capable of preheating the saturated steam output from the steam accumulator heat storage system; and the heat regenerator is capable of preheating the saturated steam output from the steam accumulator heat storage system through steam extracted from the heat supply network;

wherein the control method comprises the following steps:

calculating, according to a gap flow rate of heat supply steam and a gap duration of the heat supply steam, a flow rate of heat storage steam and a flow rate of heating molten salt in a heat storage stage, and calculating a flow rate of the heat supply steam and a flow rate of heat supply molten salt in a heat release stage;

in the heat storage stage:

controlling a real-time flow rate of extracted steam at the preset steam extraction position of the steam power cycle unit according to the flow rate of the heat storage steam, and controlling a real-time flow rate of molten salt that needs to be heated in the molten salt heat storage system according to the flow rate of the heating molten salt until a requirement on total mass of required heat storage steam is met, wherein the total mass of the required heat storage steam is determined by the gap flow rate of the heat supply steam and the gap duration of the heat supply steam;

in the heat release stage:

controlling, according to the flow rate of the heat supply steam, a real-time flow rate of saturated steam output from the steam accumulator heat storage system to the second steam-molten salt heat exchanger until the heat release stage ends, wherein when a starting condition is satisfied, the saturated steam output from the steam accumulator heat storage system is preheated by the preheating system to a temperature not lower than the solidifying point temperature of the molten salt and then is output to the second steam-molten salt heat exchanger; and controlling, according to the flow rate of the heat supply molten salt, a real-time flow rate of the molten salt for heating in the molten salt heat storage system until the heat release stage ends.

2. The control method for the steam power cycle thermoelectric decoupling system according to claim 1, wherein the heater is a steam heater;

a primary side of the steam heater is connected to the steam power cycle unit, a steam inlet of a secondary side of the steam heater is connected to the steam outlet of the steam accumulator heat storage system, and a steam outlet of the secondary side of the steam heater is connected to the end of the steam side of the second steam-molten salt heat exchanger; and the steam heater is capable of preheating the saturated steam output from the steam accumulator heat storage system through the steam extracted from the steam power cycle unit.

3. The control method for the steam power cycle thermoelectric decoupling system according to claim 1, wherein the preheating system further comprises a bypass pipeline;

one end of the bypass pipeline is connected to the steam outlet of the steam accumulator heat storage system, and the other end of the bypass pipeline is connected to the end of the steam side of the second steam-molten salt heat exchanger.

4. The control method for the steam power cycle thermoelectric decoupling system according to claim 1, wherein a first regulating valve is arranged between the steam inlet of the heater and the steam outlet of the steam accumulator heat storage system, and a second regulating valve is arranged between the steam inlet of the secondary side of the heat regenerator and the steam outlet of the steam accumulator heat storage system; and a fifth regulating valve is arranged between a steam inlet of the primary side of the heat regenerator and the heat supply network.

5. The control method for the steam power cycle thermoelectric decoupling system according to claim 1, wherein a third regulating valve is arranged between the preset steam extraction position of the steam power cycle unit and the end of the steam side of the first steam-molten salt heat exchanger, and a fourth regulating valve is arranged between the other end of the steam side of the first steam-molten salt heat exchanger and the steam inlet of the steam accumulator heat storage system.

6. The control method for the steam power cycle thermoelectric decoupling system according to claim 3, wherein a sixth regulating valve is arranged on the bypass pipeline.

7. The control method for the steam power cycle thermoelectric decoupling system according to claim 1, wherein when the steam accumulator heat storage system comprises one steam accumulator, calculating, according to the gap flow rate of the heat supply steam and the gap duration of the heat supply steam, the flow rate of the heat storage steam and the flow rate of the heating molten salt in the heat storage stage specifically comprises:

calculating a total mass of the heat supply steam according to the gap flow rate of the heat supply steam and the gap duration of the heat supply steam;

determining, according to the total mass of the heat supply steam, parameters of a full-charged final state of the single steam accumulator satisfying a heat supply condition, wherein the parameters of the full-charged final state comprise a pressure and a saturation temperature in the full-charged final state;

calculating, according to the parameters of the full-charged final state of the single steam accumulator satisfying the heat supply condition, a mass of heating steam that is capable of being stored in the single steam accumulator as a target mass;

calculating the flow rate of the heat storage steam and a duration of the heat storage stage according to the target mass; and calculating the flow rate of the heating molten salt by using a principle of energy conservation according to the flow rate of the heat storage steam.

8. The control method for the steam power cycle thermoelectric decoupling system according to claim 1, wherein when the steam accumulator heat storage system comprises a plurality of steam accumulators, calculating, according to the gap flow rate of the heat supply steam and the gap duration of the heat supply steam, the flow rate of the heat storage steam and the flow rate of the heating molten salt in the heat storage stage specifically comprises:

calculating a total mass of the heat supply steam according to the gap flow rate of the heat supply steam and the gap duration of the heat supply steam;

calculating total energy of steam and water and a total mass of the steam and water in a single steam accumulator in a full-charged final state;

calculating, according to the total energy of the steam and water and the total mass of the steam and water in the single steam accumulator in the full-charged final state, a mass of heating steam that is capable of being stored in the single steam accumulator;

calculating, according to the total energy of the steam and water and the total mass of the steam and water in the single steam accumulator in the full-charged final state, a mass of the heat supply steam that is capable of being provided by the single steam accumulator;

calculating, according to the mass of the heat supply steam that is capable of being provided by the single steam accumulator and the total mass of the heat supply steam, a quantity of required steam accumulators as a target quantity;

calculating the flow rate of the heat storage steam and a duration of the heat storage stage according to a target mass, wherein the target mass is a total mass of the heating steam that is capable of being stored in the target quantity of the steam accumulators in the heat storage stage; and calculating the flow rate of the heating molten salt by using a principle of energy conservation according to the flow rate of the heat storage steam.

9. The control method for the steam power cycle thermoelectric decoupling system according to claim 7, wherein the heat supply condition is:

$$m_g \geq m_{heat1};$$

$$m_g = \frac{\left(m_a - \frac{m_a \times h_{g2} - H_a}{h_{g2} - h_{w2}}\right) \times v_{g2} - \left(V_3 - \frac{m_a \times h_{g2} - H_a}{h_{g2} - h_{w2}} \times v_{w2}\right)}{v_{g2}};$$

$$m_a = m_{w1} + m_{g1};$$

$$H_a = H_{w1} + H_{g1};$$

$$m_{w1} = \frac{V_{w1}}{v_{w1}};$$

$$m_{g1} = \frac{V_{g1}}{v_{g1}};$$

$$H_{w1} = \frac{m_{w1}}{h_{w1}};$$

$$H_{g1} = \frac{m_{g1}}{h_{g1}};$$

$$V_{w1} = \pi \times L^2 \times r_3 - \frac{\pi \times L^3}{3};$$

$$V_{g1} = V_3 - V_{w1};$$

wherein $m_g$ is the mass of the heat supply steam that is capable of being provided by the single steam accumulator, $m_{heat1}$ is the total mass of the heat supply steam, $m_a$ is the total mass of the steam and water in the single steam accumulator in the full-charged final state, $H_a$ is the total energy of the steam and water in the single steam accumulator in the full-charged final state, $h_{w2}$ and $h_{g2}$ are respectively a specific enthalpy value of saturated water and a specific enthalpy value of saturated steam in the steam accumulator in a final state after steam supply, and $v_{w2}$ and $v_{g2}$ are respectively a specific volume of the saturated water and a specific volume of the saturated steam in the single steam accumulator in the final state after steam supply;

$m_{w1}$ and $m_{g1}$ are respectively a mass of the water and a mass of the steam in the single steam accumulator in the full-charged final state, and $H_{w1}$ and $H_{g1}$ are respectively energy of the water and energy of the steam in the single steam accumulator in the full-charged final state;

$V_{w1}$ and $V_{g1}$ are respectively a volume of the water and a volume of the steam in the single steam accumulator in the full-charged final state, and $v_{w1}$ and $v_{g1}$ are respectively a specific volume of the saturated water and a specific volume of the saturated steam in the single steam accumulator in the full-charged final state;

$h_{w1}$ and $h_{g1}$ are respectively a specific enthalpy value of the saturated water and a specific enthalpy value of the saturated steam in the single steam accumulator in the full-charged final state; and $h_{w1}$, $h_{g1}$, $v_{w1}$, and $v_{g1}$ are respectively obtained in a mode of searching a steam enthalpy-entropy table according to the parameters of the full-charged final state; and L is a liquid level height in the single steam accumulator in the full-charged final state, $r_3$ is a radius of the single steam accumulator, and $V_3$ is a volume of the single steam accumulator.

10. The control method for the steam power cycle thermoelectric decoupling system according to claim 8, wherein a pressure of the single steam accumulator in the full-charged final state is a rated pressure, and a saturation temperature of the single steam accumulator in the full-charged final state is the saturation temperature corresponding to the rated pressure;

wherein calculating the total energy of the steam and water and the total mass of the steam and water in the single steam accumulator in the full-charged final state specifically comprises:

determining, according to the rated pressure and the saturation temperature corresponding to the rated pressure, the specific enthalpy value of the saturated water, the specific enthalpy value of the saturated steam, the specific volume of the saturated water, and the specific volume of the saturated steam in the single steam accumulator in the full-charged final state in a mode of searching the steam enthalpy-entropy table; and calculating the total energy of the steam and water and the total mass of the steam and water in the single steam accumulator in the full-charged final state according to the specific enthalpy value of the saturated water, the specific enthalpy value of the saturated steam, the specific volume of the saturated water, and the specific volume of the saturated steam.

11. The control method for the steam power cycle thermoelectric decoupling system according to claim 10, wherein formulas for calculating the total energy of the steam and water and the total mass of the steam and water in the single steam accumulator in the full-charged final state according to the specific enthalpy value of the saturated water, the specific enthalpy value of the saturated steam, the specific volume of the saturated water, and the specific volume of the saturated steam are as follows:

$$m_a = m_{w1} + m_{g1};$$

$$H_a = H_{w1} + H_{g1};$$

-continued $$m_{w1} = \frac{V_{w1}}{v_{w1}};$$

$$m_{g1} = \frac{V_{g1}}{v_{g1}};$$

$$H_{w1} = \frac{m_{w1}}{h_{w1}};$$

$$H_{g1} = \frac{m_{g1}}{h_{g1}};$$

$$V_{w1} = \pi \times L^2 \times r_3 - \frac{\pi \times L^3}{3};$$

$$V_{g1} = V_3 - V_{w1};$$

wherein $H_a$ is the total energy of the steam and water in the single steam accumulator in the full-charged final state, $m_a$ is the total mass of the steam and water in the single steam accumulator in the full-charged final state, $m_{w1}$ and $m_{g1}$ are respectively the mass of the water and the mass of the steam in the single steam accumulator in the full-charged final state, and $H_{w1}$ and $H_{g1}$ are respectively the energy of the water and the energy of the steam in the single steam accumulator in the full-charged final state;

$V_{w1}$ and $V_{g1}$ are respectively the volume of the water and the volume of the steam in the single steam accumulator in the full-charged final state, and $v_{w1}$ and $v_{g1}$ are respectively the specific volume of the saturated water and the specific volume of the saturated steam in the single steam accumulator in the full-charged final state;

$h_{w1}$ and $h_{g1}$ are respectively the specific enthalpy value of the saturated water and the specific enthalpy value of the saturated steam in the single steam accumulator in the full-charged final state; and L is the liquid level height in the single steam accumulator in the full-charged final state, $r_3$ is the radius of the single steam accumulator, and $V_3$ is the volume of the single steam accumulator.

12. The control method for the steam power cycle thermoelectric decoupling system according to claim 8, wherein calculating, according to the total energy of the steam and water and the total mass of the steam and water in the single steam accumulator in the full-charged final state, the mass of the heat supply steam that is capable of being provided by the single steam accumulator specifically comprises:

calculating, according to the total energy of the steam and water and the total mass of the steam and water in the single steam accumulator in the full-charged final state, the mass of the heat supply steam that is capable of being provided by the single steam accumulator by using the following formula:

$$m_g = \frac{\left(m_a - \frac{m_a \times h_{g2} - H_a}{h_{g2} - h_{w2}}\right) \times v_{g2} - \left(V_3 - \frac{m_a \times h_{g2} - H_a}{h_{g2} - h_{w2}} \times v_{w2}\right)}{v_{g2}};$$

wherein $m_g$ is the mass of the heat supply steam that is capable of being provided by the single steam accumulator, $m_a$ is the total mass of the steam and water in the single steam accumulator in the full-charged final state, $H_a$ is the total energy of the steam and water in the single steam accumulator in the full-charged final state, $h_{w2}$ and $h_{g2}$ are respectively the specific enthalpy value of the saturated water and the specific enthalpy value of the saturated steam in the steam accumulator in the final state after steam supply, and $v_{w2}$ and $v_{g2}$ are respectively the specific volume of the saturated water and the specific volume of the saturated steam in the steam accumulator in the final state after steam supply.

13. The control method for the steam power cycle thermoelectric decoupling system according to claim 1, wherein before entering the heat storage stage, further comprising:

supplementing liquid water in the steam accumulator of the steam accumulator heat storage system to an initial water mass.

14. The control method for the steam power cycle thermoelectric decoupling system according to claim 1, wherein before entering the heat storage stage, further comprising:

calculating a water supplement mass according to a mass of the heat storage steam in a previous auxiliary heat supply cycle and a mass of the heat supply steam in the previous auxiliary heat supply cycle, wherein an auxiliary heat supply cycle comprises the heat storage stage and the heat release stage; and supplementing the liquid water with the water supplement mass to the steam accumulator of the steam accumulator heat storage system.

15. The control method for the steam power cycle thermoelectric decoupling system according to claim 1, wherein the real-time flow rate of the saturated steam output from the steam accumulator heat storage system to the second steam-molten salt heat exchanger is determined by a real-time flow rate of saturated steam output to the preheating system; and wherein controlling the real-time flow rate of the saturated steam output from the steam accumulator heat storage system to the second steam-molten salt heat exchanger according to the flow rate of the heat supply steam comprises:

controlling the real-time flow rate of the saturated steam output from the steam accumulator heat storage system to the preheating system according to the flow rate of the heat supply steam.

16. The control method for the steam power cycle thermoelectric decoupling system according to claim 1, wherein the preheating system comprises: the heater and the heat regenerator;

wherein during a period from start of heat release by the steam accumulator heat storage system to the superheated steam starting to maintain stable, the saturated steam in the steam accumulator heat storage system flows through the heater to enter the second steam-molten salt heat exchanger, and the saturated steam flowing through the heater is preheated through the heater, enabling that a temperature of the preheated saturated steam is not lower than the solidifying point temperature of the molten salt in the molten salt heat storage system; and at a stage where the superheated steam maintains stable, the saturated steam in the steam accumulator heat storage system flows through the heat regenerator and enters the second steam-molten salt heat exchanger, and the saturated steam flowing through the heat regenerator is preheated by extracting the superheated steam from the heat supply network as a preheating heat source, enabling that the temperature of the preheated saturated steam is not lower than the solidifying point temperature of the molten salt in the molten salt heat storage system, wherein the steam, as the preheating heat source, flows out of the heat regenerator, and then is mixed with the superheated steam output from the second steam-molten salt heat exchanger and enters the heat supply network.

17. The control method for the steam power cycle thermoelectric decoupling system according to claim 16 wherein the heater is a steam heater; and wherein during the period from the start of heat release by the steam accumulator heat storage system to the superheated steam starting to maintain stable, the saturated steam in the steam accumulator heat storage system flows through the steam heater to enter the second steam-molten salt heat exchanger, and the saturated steam flowing through the steam heater is preheated by extracting the steam from the steam power cycle unit as the preheating heat source, enabling that the temperature of the preheated saturated steam is not lower than the solidifying point temperature of the molten salt in the molten salt heat storage system.

18. The control method for the steam power cycle thermoelectric decoupling system according to claim 16, wherein when the starting condition is satisfied, controlling the real-time flow rate of the saturated steam output from the steam accumulator heat storage system to the preheating system according to the flow rate of the heat supply steam specifically comprises:

during the period from the start of heat release by the steam accumulator heat storage system to the superheated steam starting to maintain stable, controlling the real-time flow rate of the saturated steam output from the steam accumulator heat storage system to the heater according to the flow rate of the heat supply steam, enabling that the temperature of the preheated saturated steam is not lower than the solidifying point temperature of the molten salt in the molten salt heat storage system; and at the stage where the superheated steam maintains stable, controlling the flow rate of the saturated steam output from the steam accumulator heat storage system to the heat regenerator according to the flow rate of the heat supply steam, and controlling the flow rate of the steam extracted from the heat supply network, enabling that the temperature of the preheated saturated steam is not lower than the solidifying point temperature of the molten salt in the molten salt heat storage system.

19. The control method for the steam power cycle thermoelectric decoupling system according to claim 18, wherein the preheating system further comprises the bypass pipeline, wherein the bypass pipeline is arranged between the steam outlet of the steam accumulator heat storage system and the steam side of the second steam-molten salt heat exchanger; in the heat release stage, when the starting condition is not satisfied, the bypass pipeline is conducted, and the heat regenerator and the heater are closed; and wherein controlling the real-time flow rate of the saturated steam output from the steam accumulator heat storage system to the preheating system according to the flow rate of the heat supply steam specifically comprises:

controlling the real-time flow rate of the saturated steam output from the steam accumulator heat storage system to the bypass pipeline according to the flow rate of the heat supply steam.

* * * * *